United States Patent [19]

Oswald et al.

[11] Patent Number: 5,017,279

[45] Date of Patent: May 21, 1991

[54] MULTISTEP PROCESS FOR THE MANUFACTURE OF NOVEL POLYOLEFIN LUBRICANTS FROM SULFUR CONTAINING THERMALLY CRACKED PETROLEUM RESIDUA

[75] Inventors: Alexis A. Oswald, Annandale; Frank J. Chen, Edison; Ramon L. Espino, Califon; Kuo L. Peng, Edison, all of N.J.

[73] Assignee: Exxon Research and Engineering Company, Florham Park, N.J.

[21] Appl. No.: 479,328

[22] Filed: Feb. 13, 1990

Related U.S. Application Data

[63] Continuation of Ser. No. 291,801, Dec. 29, 1988, abandoned.

[51] Int. Cl.[5] ..... C10G 69/02; C10G 69/06; C07C 00/00

[52] U.S. Cl. ..... 208/67; 208/18; 208/49; 208/97; 208/215; 585/10; 585/250; 585/510; 585/525

[58] Field of Search ..... 208/49, 67, 18, 97, 208/215; 585/502, 10, 510, 518, 250, 525

[56] References Cited

U.S. PATENT DOCUMENTS

| | | | |
|---|---|---|---|
| 2,570,032 | 10/1951 | Heinrich | 585/518 |
| 3,125,612 | 3/1964 | Child et al. | 585/518 |
| 3,149,178 | 9/1964 | Hamilton et al. | 585/255 |
| 3,382,291 | 5/1968 | Brennan | 585/518 |
| 3,676,521 | 7/1972 | Stearns et al. | 585/255 |
| 3,769,363 | 10/1973 | Brennan | 585/525 |
| 4,282,392 | 8/1981 | Cupples et al. | 585/10 |
| 4,319,064 | 3/1982 | Heckelsberg | 585/10 |
| 4,327,237 | 4/1982 | Imparato et al. | 585/13 |
| 4,417,082 | 11/1983 | Larkin et al. | 585/525 |
| 4,420,646 | 12/1983 | Darden et al. | 585/525 |
| 4,420,647 | 12/1983 | Hammond et al. | 585/10 |
| 4,587,368 | 5/1986 | Pratt | 585/525 |
| 4,691,072 | 9/1987 | Schick et al. | 585/525 |
| 4,711,968 | 12/1987 | Oswald et al. | 568/454 |

*Primary Examiner*—Anthony McFarlane
*Attorney, Agent, or Firm*—Richard E. Nanfeldt; Jay Simon

[57] ABSTRACT

A multistep process is disclosed for the manufacture of synthetic lubricants from the $C_8$ to $C_{24}$ linear olefin components of below liquid fuel value petroleum distillate fractions derived via the high temperature thermal cracking of petroleum residua. Such feeds contain major amounts of 1-n-olefins, n-paraffins and greater than 0.1% concentration of sulfur mostly in the form aromatic, thiophene type sulfur compounds.

In the first step of the present process such feeds are enriched in the straight chain aliphatic hydrocarbon components by one or more separation processes, preferably via urea adduction or by crystallization. In the second step, the olefin components are oligomerized to sulfur containing $C_{30}$ to $C_{60}$ polyolefins, preferably in the presence of $BF_3$ complex catalysts. In the third step, the polyolefins are hydrogenated to novel isoparaffin lubricants in the presence of sulfur resistant catalysts, preferably transition metal sulfides.

8 Claims, 4 Drawing Sheets

MULTISTEP PROCESS FOR THE MANUFACTURE OF NOVEL POLYOLEFIN LUBRICANTS FROM SULFUR CONTAINING THERMALLY CRACKED PETROLEUM RESIDUA

This is a continuation of application Ser. No. 291,801, filed Dec. 29, 1988, now abandoned.

FIELD OF THE INVENTION

The present invention provides a multistep process for the conversion of the olefinic components of thermally cracked petroleum residua to novel paraffin products useful as synthetic lubricants. The preferred feed is produced by the high temperature thermal cracking of vacuum resids, particularly by Fluid-coking and Flexicoking. The distillate products of these processes contain high percentages of the desired linear olefin reactants. Due to the presence of relatively high amounts of sulfur these distillates are below liquid fuel value.

One aspect of the invention is the description of the types of compounds produced by the thermal cracking of petroleum resids. The desired 1-n-olefin and linear internal olefin components of light gas oil distillates, derived by cracking vacuum resids in fluidized bed processes, were particularly investigated. They were characterized by a combination of high resolution capillary gas chromatography (GC) mass spectrometry (MS) and nuclear magnetic resonance spectroscopy (NMR). The aromatic components and sulfur compounds present in cracked distillates were also analyzed because they potentially interfere with the desired oligomerization of the olefin components.

Another aspect of the invention is the separation of the desired linear olefin components of cracked petroleum distillates. The separation via urea adduction and by crystallization of mixtures of 1-n-olefins and n-paraffins is particularly taught. Appropriate carbon range fractions of such mixtures can be used as a feed for oligomerization reactions without prior paraffin separation. Extraction of the coker distillate feed can be used for the removal of the aromatic components, including most of the sulfur compounds. Membrane separation can result in an aliphatic and an aromatic hydrocarbon rich fraction.

A key aspect of the invention is the oligomerization of the linear olefin mixtures derived from cracked petroleum distillates to provide intermediates for synthetic lubricants. The dimers, trimers and tetramers derived from $C_{10}$ to $C_{17}$ 1-n-olefins are particularly described.

The final step in the production of the isoparaffin lubricants via the process is the hydrogenation of the polyolefin intermediates in the presence of known hydrogenation catalysts. The elimination of the unsaturation of polyolefins is a necessary step in producing synthetic lubricants of outstanding stability.

Aside from the multistep process, the other major aspect of the present invention relates to the unique structure and lubricant properties of the products. In this respect branching and molecular weight of the isoparaffin products and their viscosity and low temperature properties are particularly discussed.

BACKGROUND OF THE INVENTION

The synthesis, properties and applications of lubricants are summarized in a monograph entitled "Lubricants and Related Products" by Dieter Klamann. This book, published by Verlag Chemie, Weinheim, W. Germany in 1984 has a chapter (pages 96 to 106) which specifically discusses synthetic hydrocarbon lubricants, including those derived from olefins. As such the chapter and its citations are incorporated into this memorandum by reference. Some of the key patents and publications are discussed in the following. Although this discussion is largely contrasting the prior art with the multistep manufacturing process for lubricants of the present invention, the description of the single steps of prior art processes also provides information applicable in the practice of the present invention and a such is incorporated into the present application by reference.

The preparation of synthetic lubricants via olefin oligomerization in general is well known in the prior art. J. A. Brennan of Mobil published an early review of the literature in the journal, Ind. Eng. Chem., Prod. Res. Dev. Vol. 19, pages 2–6 in 1980 and the references of this article. Brennan particularly investigated the oligomerization of even carbon number $\alpha$-olefins from ethylene. His work was aimed at getting isoparaffins of wide temperature range fluidity via the hydrogenation of the oligomer intermediates. Based on this work, he concluded that decene trimers obtained via $BF_3$ catalyzed oligomerization provide superior lubricant fluids on hydrogenation. Such trimers are a main component of the commercial Mobil 1 synthetic lubricant.

While 1-decene based synthetic hydrocarbon lubricants have excellent quality, their economics of manufacture are unfavorable. 1-Decene is only one of the products of ethylene oligomerization. Therefore, its availability is limited and its price is very high. There is a great need for other synthetic hydrocarbon lubricants of greater availability and lesser cost.

The above referred Brennan publication and an article by Onopchenko, Cupples and Kresge in Ind. Eng. Chem., Prod. Res. Dev. Vol. 2, pages 182–191 in 1983 discussed the structures of various potential hydrogenated polyolefin lubricant candidates and correlated them with their low temperature behavior characterized by solidification temperatures or pour points and wide temperature behavior indicated by their viscosity indices. They found that isoparaffins having short n-alkyl segments had outstanding low temperature behavior, but poor viscosity characteristics. In contrast, long n-alkyl segments assure desirable viscosity but lead to poor low temperature behavior. The design of lubricants having balanced properties apparently calls for an innovative compromise in molecular design. It appears that isoparaffins in the $C_{25}$ to $C_{60}$ carbon range per molecule are good lubricant candidates, if they have 1 to 3 alkyl side chains of medium chain length on the n-alkane carbon skeleton as close to the center of the molecule as possible.

One of the prior art approaches to isoparaffins of improved economics is described by Petrillo et. al. in U.S. Pat. No. 4,167,534. According to this patent, the feed for oligomerization is $C_{11}$ to $C_{14}$ mixture of n-olefins having double bonds statistically distributed along the entire chain. Such olefins are obtained via the dehydrogenation of the corresponding paraffins as prepared by the ISOSIV process and are utilized as the feed. Oligomerization is carried out in the presence of a Friedel Crafts catalyst, preferably $AlCl_3$. The hydrogenated oligomers have an excellent low temperature behavior, i.e. pour points of $-50°$ C. or lower and kinematic viscosities at 40° C. in the range of about 30 to 40 centistokes.

Another approach to synthetic lubricants is disclosed by L. Heckelsberg in U.S. Pat. No. 4,317,948 assigned to Phillips Petroleum Co. In the first step, Heckelsberg produces an internal olefin, preferably via metathesis of an α-olefin. In the second step, the internal olefin is codimerized with an α-olefin. For example, 1-dodecene, is converted to a 11-docosene which is then isolated and codimerized with 1-dodecene to provide $C_{34}$ isoolefins:

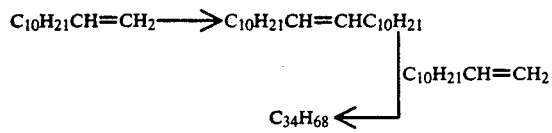

U.S. Pat. No. 4,319,064 by Heckelsberg et. al. discloses the dimerization of $BF_3$ based catalysts of internal olefin dimer fractions obtained via the metathesis of $C_8$, $C_{10}$ and $C_{12}$ α-olefins. Another method based on the metathesis of α-olefins is disclosed in U.S. Pat. No. 4,300,006 by W. T. Nelson, also assigned to Phillips. This patent describes the boron trifluoride catalyzed codimerization without prior separation of the components of a α-olefin metathesis reaction mixtures. The products of both the Heckelsberg and the Nelson patents have pour points in the range of about −32 to −54° C. and 40° C. viscosities of 100 to 133 cst.

A large number of patents have issued covering the oligomerization of linear olefins in the $C_6$ to $C_{25}$ range to lubricants. Most of them employ even carbon α-olefins as a feed. However, a few patents disclose the use of cracked wax olefins.

U.S. Pat. No. 1,955,200 by Sullivan, Jr. and Voorhees, assigned to Standard Oil Co. of Indiana, discloses the synthesis of a stable, high VI lube oil via wax cracking followed by polymerization in the presence of $AlCl_3$ as a catalyst.

U.S. Pat. No. 3,883,417, by C. Woo and J. A. Bichard, assigned to Exxon, describes a two stage process for the production of lube oils by the thermal polymerization of the olefin components of steam cracked paraffin waxes and gas oils. In the first stage, the more reactive components such as diolefins are polymerized. A distillate containing the less reactive α-olefin components is separated from the reaction mixture and converted to lubricants of high viscosity index.

U.S. Pat. No. 3,156,736 assigned to Shell also utilized cracked wax olefins for producing lubricants. In the Shell process $C_9$ to $C_{17}$ cracked wax olefins are first separated by urea clathration. Then they are purified by percolation over silica gel. The pure olefins are polymerized using an aluminum trialkyl - titanium tetrachloride catalyst system. The $C_{30}$ and higher distillate product fraction is hydrogenated to provide the lubricant product. Another U.S. Patent to Shell, No. 2,051,612 describes a process for the preparation of a suitable olefin feed for lube oil manufacture. According to this patent a paraffinous oil provides the desired olefins in a two stage cracking process.

Various acid catalysts an Ziegler-Natta type catalyst systems as well as thermal processes were utilized to oligomerize higher olefins to lubricant intermediates. Boron trifluoride based catalyst systems were most extensively investigated. U.S. Pat. No. 2,816,944 by Muessig and Lippincott to Exxon disclosed the use of a $BF_3$-$H_3PO_4$ system for the oligomerization of $C_6$ to $C_{25}$ olefins. U.S. Pat. No. 3,382,291, by Brennan to Mobil describes a process for the oligomerization of $C_5$ to $C_{20}$ α-olefins, preferably 1-decene in the presence of $BF_3$ plus a 1:1 $BF_3$ complex of water, alcohol, acids, ethers, esters, aldehydes, and ketones. Another Mobil patent, i.e. U.S. Pat. No. 3,769,363, specifically claims the oligomerization of $C_6$-$C_{12}$ olefins with $BF_3$ pentanoic acid complexes. In U.S. Pat. No. 4,213,001, by Madgavkar et. al. assigned to Gulf, the oligomerization of $C_6$ to $C_{12}$ α-olefins in the presence of $BF_3$ treated adsorbent silica is claimed. U.S. Pat. No. 4,218,330, by Shubkin to Ethyl Corp. specifically discloses the dimerization of $C_{12}$ to $C_{18}$ α-olefins in the presence of boron trifluoride hydrate. A similar process using a perfluorosulfonic acid resin Nafion alone or complexed with $BF_3$ is disclosed in U.S. Pat. Nos. 4,367,352 and 4,400,565, assigned to Texaco. For the oligomerization of linear olefins containing major amounts of less reactive internal isomers U.S. Pat. No. 4,420,646, by Darden, Walts and Marquis of Texaco, discloses the use of a promoted $BF_3$ catalyst 17,082, also from Texaco, describes the cooligomerization of $C_3$–$C_5$ and $C_8$–$C_{18}$ α-olefins with a similar catalyst system at close to ambient temperature.

As indicated above the linear olefin feeds for lubricant synthesis of the prior art were mostly derived via ethylene polymerization. These feeds did not require the application of olefin separation processes. The only relatively complex feeds employed were cracked distillates. These contained a mixture of mostly linear olefins but no aromatics and sulfur compounds. As it will be discussed the linear olefin and paraffin components of cracked wax were separated via urea adduction to produce feeds for synthetic lubricants. Urea adduction is also applicable to the thermally cracked, residua derived feeds of the present process.

The urea adduction method for the separation of straight chain hydrocarbons and monosubstituted derivatives was discovered by Bengen in Germany during World War II (see German Patent No. 869,070). This method was commercially developed, primarily for the dewaxing of mineral oil fractions, i.e. the separation of n-paraffins from hydrocarbon mixtures of aliphatic character. This development was reviewed by Alfred Hoppe of Edeleanu Gmbh, in Chapter 4, pages 192 to 234 of Volume 8 of a series of monographs on "Advances in Petroleum Chemistry and Refining" edited by J. J. McKetta Jr., and published by Interscience Publishers of J. Wiley & Sons, New York, 1964. The urea adducts of straight chain paraffins and olefins which are of special petrochemical interest were described by Schlenk, Jr. in Fortschritte de Chemischen Forschung, Volume 2, page 92 in (1951), by E. Terres and S. Nath Sur in Brennstoff-Chemie, Volume 38, pages 330 to 343 in 1957 and by W. G. Domagk and K. A. Kobe in Petroleum Refiner, Volume 34, No. 4, pages 128-133 in 1955.

The urea adduction method was employed for the separation of o-olefins as well as n-paraffins. L. C. Fetterly discussed the separation of α-olefin - n-paraffin mixtures via urea adduction from cracked wax, thermally cracked gas oil and naphtha in Petroleum Refiner, No. 4, pages 128–133 in 1955. Such separations were disclosed in detail by Garner et. al. in U.S. Pat. No. 2,528,677 assigned to Shell, by Woodbury in U.S. Pat. No. 2,642,421 assigned to Socony-Vacuum Oil and by Goldsbrough of Shell at the 1955 World Petroleum Congress, Rome, in Section III/B, Paper 4. Reference to the recovery of straight chain olefins from cracked stocks via urea adduction is also made by Bailey et. al.

in Ind. Eng. Chem., Vol. 43, pages 2125-2129 in 1951. Also, German Patent 3,436,289-A, assigned to Council of Scientific and Industrial Research in New Delhi, discloses the separation via urea adduction of the α-olefin plus n-paraffin components of coker distillates derived via cracking crude oil fractions. The patent also states that the separated olefins are useful among others in the production of synthetic lubricants. However, the coker distillates employed were apparently of low sulfur content. The patent states that sulfur compounds inhibit urea adduct formation and thus teaches away from the present invention.

Urea adduction was employed commercially for the separation of n-paraffins in dewaxing. Several processes were developed on a pilot plant scale. In Petroleum Refiner, Volume 36, No. 7, pages 147–152 in 1957, Fetterly reviewed the commercial urea adduction units. Most of the details are provided in the previously cited Hoppe review. The basic features of these processes are discussed in the following since they are applicable to the coker distillate feeds of the present process.

Standard Oil Co. (Indiana) operated a dewaxing unit for the production of lubricating oil. The chemical basis of this unit has been described by Zimmerschied and coworkers in Ind. Eng. Chem., Vol 42, pages 1300–1396 in 1950. This publication and Fetterly's review point out that petroleum fractions usually fail to form adducts in the absence of an activator due to the presence of inhibitors, e.g. sulfur compounds etc.. In the Indiana process, probably methanol was used as an activator solvent.

Deutsche Erdoel produced low-pour diesel oil spindle oil via urea adduction as described by Hoppe in Erdoel und Kohle, Vol. II, pages 618 to 621 in 1958. The process employed was designed by Edeleanu and employed an aqueous reactant solution. A variant of the Edeleanu process using an aqueous isopropanol solution of urea was developed in Russia and has been described by J. Bathory in Chem.-Anlagen Verfahren, No. 3, pages 43 to 46 in 1972.

A process first employed by Sonneborn and Sons to produce white oil employed a crystalline urea reactant. This type of a process was more recently also developed by Nippon Mining and Chiyoda Chem. Eng. and Constr. Co.. Under the name Nurex, the process was designed for producing a n-paraffin feed for single protein production. The Nurex process was described in Bull. of the Japan Petr. Inst , Vol 8, June 7–12 issue (1966), the oil and Gas J., Vol. 70, No. 4, pages 141, 142 in 1972. A detailed comparison of the Nurex process with the Edeleneau process was made in the previously referred journal article by Bathory.

Shell Oil Co. developed a process applicable for the separation of the α-olefin and n-paraffin components of cracked wax which was described by the earlier quoted Bailey et. al., paper in Ind. Eng. Chem., a paper in the Proceedings of the 2nd World Petr. Congr., Hague, Sect. III, pages 161–171 also by Bailey et. al. and another paper by Goldsbrough which was also referenced earlier. This process employs both an organic solvent, methyl i-butyl ketone, and water and obtains the urea adducts by phase separation rather than filtration. Societe Francais des Petroles also developed a process based on the same phase separation principle.

Finally, a separation process using urea in partition chromatography was also disclosed in U.S. Pat. No. 2,912,426 assigned to Gulf. This process was successfully employed as an analytical technique for the determination of the major α-olefin and n-paraffin components of coal tar pitch (See Karr and Comberiati, J. Chromatog., Vol. 18, No. 2, pages 394–397, 1965).

The straight chain hydrocarbon components of distillate by-products of the thermal cracking of petroleum residua, with superheated steam to produce pitch to replace coking coal, were separated by the urea adduction process for analytical studies. This was reported by Ohnuma et. al. in J. Japan Petrol. Inst., Vol. 21, pages 28–34 in 1978. From a light oil fraction of 49% oil content up to 25% yields of linear hydrocarbons were obtained. Gas chromatography showed that these consisted mostly of n-paraffins (about 70%) and 1-n-olefins (20%). The minor components were I-methylparaffins and internal n-olefins.

European Patent Application No. 164,229 by Atsushi et. al. assigned to Nippon Petrochemicals Company disclosed a method of upgrading to paraffins thermally cracked distillate products derived from petroleum residua. According to this method, the olefin components of the distillate are reacted with the aromatic components to produce alkylaromatic compounds in the presence of an acid catalyst in the first step. The unreacted, paraffin rich components of the feed are then separated by distillation from the reaction mixture in the second step. The n-paraffins could then be isolated via urea adduction or by molecular sieve.

Aboul-Gheit, Moustafa and Habib reported, (in Erdoel und Kohle-Erdgas, Vol. 36, page 462 to 465 in 1985), the isolation in 30% yield of a linear hydrocarbon mixture consisting 35.6% n-olefins and 64.4% paraffins from a $C_{11}$ to $C_{14}$ coker distillate fraction containing 43.0% olefins and 29.1% saturates. They utilized the product to prepare a linear alkylbenzene detergent intermediate by the alkylation of benzene in the presence of a silicotungstic acid catalyst. However, they neither disclosed nor suggested the use of the olefin components of the products for the synthesis of lubricants.

An alternative method of separating the α-olefin and n-paraffin components of coker distillates is crystallization. No positive teaching could be found in the literature on the direct separation of n-paraffins plus 1-n olefins by crystallization from any feed. U.S. Pat. No. 3,691,246 by L. C. Parker, T. A. Cooper and J. L. Meadows described the selective crystallization of n-paraffins from methylethyl ketone solutions of sharp distillate fractions of cracked wax consisting of n-paraffins and n-olefins. Similarly, U.S. Pat. No. 3,767,724 by Tan Hok Gouw disclosed the selective crystallization of paraffins from $CO_2$ solutions of olefin-paraffin mixtures. A journal publication by Von Horst Gundermann, Josef Weiland and Bernd Speckelsen [Erdoel and Kohle-Erdgas, Vol 24, No. 11, pages 696 to 701, (1971)] described the crystallization of $C_{16}$–$C_{20}$ n-olefin plus n-paraffin mixtures from methylnaphthalene. The formation of n-paraffin crystals was reported. The authors concluded that for the crystallization of n-olefins always significantly lower temperatures are required than for that of the corresponding n-paraffins. Thus, this paper also taught away from the cocrystallization of these components.

There is much literature on the extraction of various petroleum distillates, particularly for the production of aromatic hydrocarbon extracts. However, there is no specific information on the extraction of coker distillates. The extraction of light aromatic hydrocarbons (BTX) from petroleum distillates with polar solvents, particularly sulfolane, is reviewed in a paper presented on "The Sulfolane Extraction Process" by H. Voetter and W. C. Kosters before the Sixth World Petroleum Congress in June 1963 (Paper No. III in Section II, pages 131 to 145). This extraction process was apparently limited to the use of highly aromatic catalytic reformates, pyrolysis gasoline and coke oven gasoline. In contrast to these feeds, the gasoline range feed of the present invention has a relatively low percentage of aromatics and high percentage of straight chain aliphatic hydrocarbons, largely 1-n-olefins. While the process of the prior art was simply directed to BTX production, aliphatic hydrocarbons, particularly olefins, are important coproducts of the present process. These aliphatic hydrocarbon rich fractions are for example advantageously used as feeds in the urea adduction process.

U.S. Pat. No. 3,755,15 by H. Akayabashi, S. Hoshiyama and S. Takigawa disclosed that acetylpyrrolidone and its solvent mixtures are uniquely suitable compared to sulfolane and other known solvents for the stepwise extraction of cracked petroleum oils of undefined origin. In the first step, the aromatic hydrocarbons are extracted, in the second the olefins and naphthenes. In contrast, for the separation of thermally cracked petroleum residua, sulfolane and similar solvents were found to be effective in the present work.

U.S. Pat. No. 4,267,034 by C. O. Carter described the selective extraction by dimethyl sulfoxide-water mixtures of the olefin components of olefin-paraffin mixtures. A similar olefin extraction by alcoholic solutions of silver and copper salts is claimed in U.S. Pat. No. 4,132,747 by John F. Knifton.

No separation processes using solid adsorbents were disclosed for thermally cracked residua of high sulfur and unsaturates content to our knowledge. U.S. Pat. No. 4,517,402 by R. N. Dessau describes a process for the selective sorption of linear aliphatic compounds from vacuum gas oil by ZSM-11 type zeolites. This Dessau patent and the patents cited therein, particularly U.S. Pat. No. 3,709,979, indicate that for such separation zeolites having appropriately small pore dimension and high silica to alumina ratios are used. Most of these zeolites were used for catalytic dewaxing as described in U.S. Pat. Nos. 3,894,938; 4,149,960. As such they do not suggest the separation of a highly reactive feed such as a coker distillate without concurrent reaction.

Eluent chromatography using highly polar solids such as silica gel was employed widely in petroleum chemistry as an analytical method for determining the types of compounds present. For example, the analysis of olefin-paraffin and aromatic hydrocarbon mixtures derived by wax cracking is described using such a method by E. Kh. Kurashova, I. A. Musayev, P. I. Sanin and A. N. Rumyantsev in Neftekhimiya, Vol. 7, No. 4, pages 519 to 529 in 1967. However, these applications were analytical rather than methods for producing components for industrial utilization.

In contrast to the prior art, the present invention starts with linear olefinic products of the high temperature thermal cracking of petroleum residua, separates the straight chain hydrocarbons of such cracked distillates and oligomerizes the linear olefin components to liquid polyolefin lubricant intermediates.

The final step in synthetic lubricant manufacture is the hydrogenation of polyolefins. Since the polyolefin intermediates of the prior art contained no sulfur compounds as impurities, generally sulfur sensitive metal catalysts of hydrogenation were employed. For example, the previously discussed U.S. Pat. No. 4,420,646 by Darden et. al. particularly prefers a nickel-copper-chromium hydrogenation catalyst described in U.S. Pat. No. 3,152,998.

In contrast to the prior art, the hydrogenation step of the present process is preferably carried out in the presence of sulfur insensitive catalysts. Transition metal sulfide based catalysts are particularly preferred. For example, a CoS/MoS catalyst is used to advantage. In general, such catalysts result in the conversion of the sulfur compound impurities and their removal as hydrogen sulfide.

SUMMARY OF THE PRESENT INVENTION

Figure 1B:
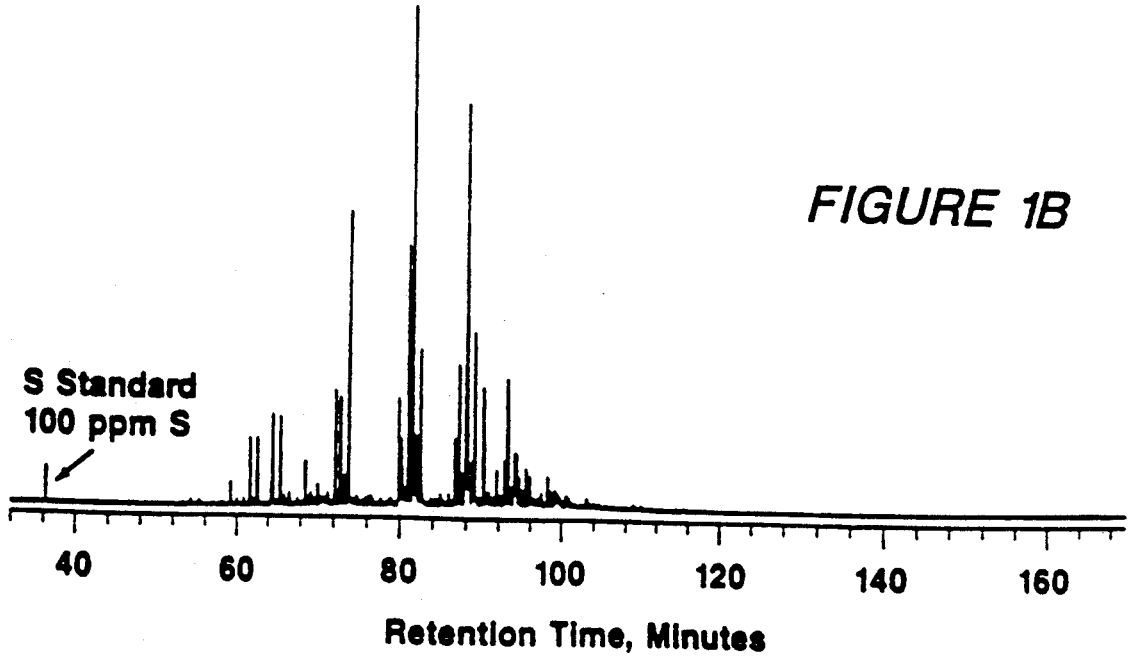
FIG. 1A and 1B for flame detector and sulfur detector, respectively illustrates by capillary gas chromatograms the composition of light Fluid-coker gas oil feeds containing major amounts of 1-n-olefins and n-paraffins plus various sulfur compounds.

The multistep process of the present invention provides a less expensive route for the manufacture of polyolefin liquid lubricants, i.e., isoparaffins derived via the oligomerization of $C_8$ to $C_{24}$ linear olefins. Such lubricants in the past were optimally prepared via the trimerization 1-n-decene. The high cost and limited availability of 1-n-decene is a major factor in limiting the use of poly-α-olefin (PAO) synthetic lubricants. Synthetic lubricants can be also derived from $C_{10}$ to $C_{24}$ internal olefins. However, the ultimate starting materials for these poly-internal olefins are also α-olefins.

It was also proposed to derive synthetic lubricants, from α-olefin products of higher molecular weight paraffin cracking. As feeds for such processes, waxes and gas oils were proposed. However, these processes are also expensive since they start with valuable, low sulfur hydrocarbon feedstocks and yield a whole range of olefins, many of them not suited for polymerization to poly-α-olefins.

In the present multistep process, below liquid fuel value, sulfur containing petroleum distillates of high α-olefins content are employed as the feed. These distillates, hereafter defined as coker distillates, are derived by the high temperature thermal cracking of petroleum residua, i.e. vacuum resids. Preferred processes producing such coker distillates are Fluid-coking and Flexicoking.

The coker distillates feeds of the present process contain major amounts of 1-n-olefins, n-paraffins and greater than 0.1% concentration of sulfur, mostly in the form of aromatic, thiophene type, sulfur compounds. There are also significant amounts of conjugated dienes present.

Fractional distillation of the cracked coker product in the refinery usually provides heavy coker naphtha and/or light coker gas oil fractions. This may suffice to provide appropriate molecular weight range feeds as part of the coking process. Additional fractional distillation may be needed to obtain narrower carbon range feeds, e.g. a $C_9$ to $C_{13}$ cut or a $C_{10}$ cut. Thus, the present coker distillate feeds are obtained either by simple refinery distillation or additional fractional distillation.

The first step of the present process is the enrichment in straight chain aliphatic hydrocarbon components, particularly 1-n-olefins, of the coker distillate feed. This is accomplished by one or more of several separation processes. A preferred separation process is urea adduction. Urea forms reversible, crystalline complexes with the 1-n-olefin and n-paraffin components of the feed. These complexes are then separated by filtration and decomposed to give an enriched feed. A preferred alternative to urea adduction is crystallization. It was surprisingly found that cooling broad distillate fractions of higher olefins containing three or more different carbon atoms results in the separation of crystalline mixtures of 1-n-olefins and n-paraffins.

Other less preferred methods of separation include liquid-liquid extraction, membrane separation and adsorption on solids such as silica gel and zeolites. These methods can be used alone or as the first step in a two step separation process. For example, extraction or membrane separation may be used to reduce the aromatics content, prior to the separation of 1-n-paraffins by crystallization.

The second step of the instant process is the polymerization, i.e. selective oligomerization of the linear olefin components of the enriched feed containing sulfur compounds to produce appropriately branched polyolefins. The polyolefin products of this step are mixtures of dimers, trimers, tetramers and pentamers. The oligomerization is preferably carried out in the presence of acid, i.e. cationic, catalysts. A specifically preferred type of catalysts is the Friedel-Crafts type such as $BF_3$ and $AlCl_3$. The oligomerization can be carried out in one or two steps. In a two step process, olefin dimers may be produced in the first step. These dimers may be then codimerized with α-olefins in the second step.

The third and final step of the instant process is the hydrogenation of the sulfur containing polyolefin product of the second step, preferably in the presence of transition metal sulfide catalysts. This hydrogenation results in a sulfur free isoparaffin product of appropriate branchiness. Such an isoparaffin has a high viscosity index, good low temperature flow properties and an outstanding high temperature stability, i.e. the desired characteristics of a polyolefin derived synthetic lubricant.

The polyolefin precursor of the synthetic lubricant produced via the present multistep process is a copolymer of major amounts of 1-n-olefins, i.e. α-olefins, including even and uneven numbered carbon compounds. As minor components such copolymers also contain units derived from linear internal olefins and methyl branched olefins. The incorporation of these minor comonomers into the present isoparaffin lubricants results in a unique balance of properties desirable in various lube applications.

DESCRIPTION OF THE PREFERRED EMBODIMENTS

The multistep process of the present invention is to manufacture polyolefin type synthetic lubricants, derived mostly from $C_8$ to $C_{24}$ linear olefin components of coker distillate fractions containing more than 0.1% sulfur. These coker distillates are produced by the high temperature thermal cracking of petroleum residua. The process comprises the following three steps:

(a) Enrichment of a coker distillate feed in 1-n-olefin and n-paraffin components by one or more separation processes including urea adduction or crystallization, (b) Oligomerization of the $C_8$ to $C_{24}$ olefin components of an enriched coker distillate fraction to produce sulfur containing $C_{30}$ to $C_{60}$ polyolefins, and (c) Hydrogenation of the sulfur containing polyolefins to isoparaffins with the simultaneous removal of the sulfur.

The coker distillates of the present invention contain 1-n-olefins as the major type of olefin components. The percentage of the Type I olefins is preferably more than 30% of the total olefins. The preferred distillates contain organic sulfur compounds in concentrations exceeding 0.5 wt.% sulfur equivalent.

In the first step of the present process, the coker distillate feed is enriched in 1-n-olefin and n-paraffin components. Specifically, preferred separation processes for enrichment include the urea adduction and crystallization of these components.

In the second step of the present process, the $C_8$ to $C_{24}$ olefin components of an enriched coker distillate fraction are oligomerized to sulfur containing $C_{30}$ to $C_{60}$ polyolefins, preferably in the presence of a Friedel-Crafts catalyst, most preferably in the presence of a boron trifluoride complex catalyst.

In the third step, the sulfur containing polyolefins are hydrogenated to isoparaffins with the simultaneous removal of sulfur as hydrogen sulfide in the presence of transition metal sulfide catalysts.

The present invention also covers a novel polyolefin type synthetic lubricant composition derived mostly from $C_8$ to $C_{24}$ linear olefins, preferably $C_9$ to $C_{13}$ 1-n-olefin rich linear olefins wherein said olefins contain 1-n-olefins as major components and internal n-olefins and methyl branched components as minor components, and said olefin mixture is separated from a coker distillate feed containing α-n-olefins and n-paraffins as major components, and oligomerized in the presence of acid catalysts to a polyolefin comprising 2 to 6 monomer units, said polyolefin product mixture containing n-paraffins then being hydrogenated to provide a mixture of isoparaffin lubricants and unconverted n-paraffins from which the paraffins are then removed preferably by distillation or said mixture of n-olefins and n-paraffins is first subjected to distillation to remove the paraffins and then hydrogenated to provide the novel isoparaffin lubricants.

SPECIFIC DETAILS OF THE EMBODIMENTS

The specific details of the embodiments of the present invention will be discussed in terms of the hydrocarbon feeds and separation processes employed. Separation via urea adducts will be particularly discussed. Thereafter, the selective conversion of the n-olefin components of the n-olefin and n-paraffin mixtures obtained in the separation step will be discussed. Oligomerization to synthetic polyolefin lubricants will be particularly described.

Olefinic Thermally Cracked Feeds

The preferred hydrocarbon feeds of the present invention contain major amounts of olefins, paraffins and aromatic compounds. More preferably the feeds also contain significant amount of sulfur compounds. A detailed description of the most preferred feeds, i.e. distillate feeds, produced from petroleum residua by high temperature thermal cracking processes such as Fluid-coking and Flexicoking is found in U.S. Pat. No. 4,711,968 and U.S. Patent application Ser. No. 105,171 of Oct. 5, 1987 by Oswald et al. which are incorporated in their entirety by reference.

The olefinic feed of the present process is a critical factor in producing the polyolefin lubricants of the present invention at a low cost. Such a feed is produced by high temperature thermal cracking of petroleum residua. The percentages of 1-n-olefin and other olefin components of petroleum distillates generally increase with the temperature of cracking.

Thermal cracking processes produce hydrocarbons of more linear olefinic character than catalytic cracking. The presence of linear olefin components, particularly 1-n-olefins, in the cracked distillates is important in producing an olefinparaffin mixture of high 1-n-olefin content in the separation step. 1-n-Olefins are more readily oligomerized than internal n-olefins. They lead to polyolefins and, in turn, isoparaffins containing longer alkyl branches than the corresponding internal linear olefins. An appropriate number and length of alkyl chains is critical for the high performance of isoparaffin products.

There are two main commercial processes for producing thermally cracked petroleum distillates from residua. They were reviewed by Jens Weitkamp in the journal, entitled Chem. Ing. Tech. Nos. 2, pages 101–107 in 1982. These processes are coking and visbreaking, representing severe and mild cracking processes. The main coking processes are Flexicoking and Fluid-coking which produce the preferred distillate feeds of the present invention.

Suitable distillate feeds can be also prepared in thermal processes employing a plurality of cracking zones at different temperatures. Such a process is described in U.S. Pat. Nos. 4.477.334 and 4,487,686. Each of these thermal cracking processes can be adjusted to increase the olefin content of their products. Heavy gas oil distillates can be further cracked to increase the amount of lower molecular weight olefins.

The coker distillate feeds of the present invention are preferably in the $C_8$ to $C_{24}$ carbon range where the linear olefins and n-paraffins can be separated via urea adduction or crystallization. Light coker gas oil refinery fractions are usually in that carbon range. The preference for fractions within this range depends on the specific use requirements of the polyolefin lubricants to be produced.

The preferred cracked distillates of the present feed contain relatively high amounts of organic sulfur compounds. The sulfur concentration is preferably greater than 0.1% (1000 ppm), more preferably greater than 1% (10,000 ppm). The prevalent sulfur compounds in these feeds are aromatic, mainly thiophenic. Most preferably the aromatic sulfur compounds represent more than 90% of the total. This finding is important for the present process since thiophenes, benzothiophenes and similar aromatic sulfur compounds do not inhibit the separation of the desired 1-n-olefins.

The olefin containing distillate fractions of thermal cracking processes may be employed as feeds in the process of the invention without prior purification. However, these distillate fractions may optionally be treated prior to their use to reduce the concentrations of aromatic hydrocarbons conjugated dienes, sulfur and nitrogen compounds if so desired. For example, aromatic hydrocarbons and sulfur compounds can be selectively extracted from the olefin containing fraction by polar solvents. A similar separation of aromatics from aliphatic compounds can be achieved using membranes. Shape selective zeolite adsorbents can be also used for the separation of n-olefins plus n-paraffins.

Nitrogen and sulfur compounds in general can be removed by use of absorption columns packed with polar solids such as silica, Fuller's earth, bauxite and the like. Sulfur compounds can be also removed by acid treatment. For example, treatment with $BF_3$ complexes can result in the alkylation of thiophene type sulfur compounds by the conjugated diene and branched olefin components of the feed. The conjugated olefin components of the present feeds may also be removed by prior mild hydrogenation to monoolefins.

The light coker gas oil (LKGO) feed from the refinery is preferably further fractionated prior to use in the present process. It is preferred to distill a forerun fraction of LKGO up to $C_{17}$ and use it in the present process. Narrow gas oil fractions, containing aliphatic hydrocarbons having as low as three different carbon atoms, such as $C_9$ to $C_{11}$, can be also employed. However, single carbon LKGO fractions cannot be utilized for linear olefin plus n-paraffin separation by crystallization. The separation of single carbon LKGO fractions such as an olefinic $C_{10}$ fraction is though possible via urea adduction.

The olefin content of the present cracked distillate feeds is above 30%. The 1-n-olefins are the major type components.

The main olefin reactant components of the present feeds are nonbranched Types I and II plus monobranched Types III and IV as indicated by the following formulas (R=hydrocarbyl, preferably nonbranched alkyl):

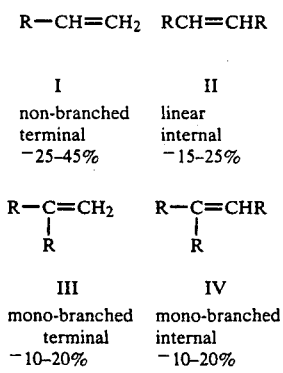

The R groups in the formulas of the various types of olefins can be straight chain or branched alkyl groups. However, the alkyl groups of the preferred coker olefins of Type I and Type II are predominantly either straight chain or monomethyl branched. Additionally, the Type III and Type IV olefin components of these preferred feeds predominantly possess a methyl group as one of the alkyl groups on the completely substituted vinylic carbon. NMR also indicated the presence of minor amounts of conjugated dienes ranging from about 2 to about 10% concentration. The concentration of the various olefins generally decreases with their molecular weight, i.e. carbon number. Therefore, coker distillates having more than 24 carbons per molecule are less preferred.

The paraffin components of the preferred coker distillate feeds are present in concentrations similar to but smaller than the olefin components. The n-paraffins are the major single types of paraffins present. The branched paraffins are largely methyl branched. Monomethyl branched paraffins are prevalent.

The aromatic hydrocarbons of the present feeds have a concentration range from about 6% to about 50%. The percentage of the aromatic components increases with the carbon number of the distillate fractions. Of course the percentages of olefins and paraffins decrease accordingly. In the preferred $C_9$ to $C_{19}$ carbon range the concentration of aromatics is between about 10 and about 50%.

The aromatic hydrocarbon components of these feeds are predominantly unsubstituted parent compounds such as benzene or substituted with methyl groups such as toluene. The concentration of ethyl substituted compounds is much smaller. Propyl substituted aromatics are present in insignificant amounts. Up to 12 carbon atoms, the aromatics are benzenoid hydrocarbons. From $C_{12}$ to $C_{15}$ most aromatics are of the naphthalene type. Among the higher carbon number hydrocarbons most aromatics are three member fused ring compounds such as anthracenes and phenanthrenes.

The concentration and type of sulfur compounds in the preferred coker distillates depend on their carbon number. The sulfur concentrations range from about 0.1% to about 3%. In general, sulfur concentrations increase with the carbon number to about 3%. In the $C_5$ to $C_7$ carbon range there are major amounts of thiols present. The $C_8$ and higher fractions contain mostly aromatic sulfur compounds, mostly of the thiophene type. The structure of aromatic thiol components is similar to those of the aromatic hydrocarbons. Methyl and ethyl substituted thiophenes are present in decreasing amounts. Alkylthiophenes are the major sulfur compounds in the $C_8$ to $C_{11}$ range. Benzothiophenes are mostly present in the $C_{12}$ to $C_{13}$ range. In higher boiling fractions dibenzothiophenes are the major sulfur compounds.

Separation Via Urea Adducts

The separation of normal olefin - n-paraffin mixtures from distillates produced by the high temperature thermal cracking of petroleum residua is preferably carried out via urea adducts by methods disclosed in the prior art. Most of these methods were described by A. Hoppe in the previously referred Chapter 4, pages 192 to 234 of Volume 8 in "Advances in Petroleum Chemistry and Refining and its references which are incorporated by reference. The commercial methods reviewed by Fetterly in Volume 36, No. 7, pages 147–152 in 1957 in Petroleum Refiner are preferred and also incorporated by reference. These methods are outlined in the following.

In the first method methanol is used as an activator solvent for urea. Another method employs an aqueous urea solution as a reactant for cracked distillates. In a third method crystalline urea reactant is employed.

Other methods may employ mixed solvent mixtures for urea such as aqueous isopropanol and aqueous methyl i-butyl ketone. The choice of solvent or solvent mixture is influenced by the solvent's characteristics and cost plus the ease of urea and solvent recycle after the decomposition of the complex. It is desirable to have a volatile solvent or solvent mixture which is not only a good solvent for urea but also has some miscibility with the cracked hydrocarbon feed. In a preferred case, contacting the urea solution reactant with the hydrocarbon feed results in the formation of a solid urea adduct precipitate and a liquid unconverted feed—excess reactant mixture from which the reactant is readily separated e.g. by distillation and water extraction.

The urea reactant is employed in several fold molar excess over the 1-n-olefin plus n-paraffin components of the feed. The molar ratio of urea to the 1-n-olefin plus n-paraffin compounds is preferably 5 or more. Increased ratios result in increased amounts of adduct precipitate. However, the ratio of urea to the n-aliphatic hydrocarbons in such adducts increases. Thus the yield of separated aliphatic hydrocarbon product per weight of urea decreases.

The solid urea adducts formed are separated preferably by filtration. The filtered adduct is voluminous and is advantageously washed with a $C_5$ to $C_8$ hydrocarbon solvent, preferably isooctane, to remove the occluded feed and reactant solution.

The separated urea adducts are decomposed, preferably by heating, to recover a mixture 1-n-olefins and n-paraffins. In a preferred operation, the adduct is added to a hot, stirred water which dissolves the urea by-product of decomposition. The 1-n-olefin - n-paraffin product mixture is insoluble in the water and as such separates as a top hydrocarbon phase.

The hydrocarbon product consists mainly of 1-n-olefins and n-paraffins. The combined percentage of 1-n-olefins and n-paraffins is preferably greater than 75%. The ratio of the 1-n-olefin versus n-paraffin components depends on their ratio in the feed and the extent of adduct formation in the complexing step. With increasing amounts of adducts formed increasing amounts of the more soluble i-n-olefin complexes precipitate. The ratio of 1-n-olefins to n-paraffins is preferably from about 0.4 to about 1.5. With the more preferred $C_{10}$ to $C_{19}$ Flexicoker feeds, ratios ranging from about 0.6 to about 1.2 were found.

Separation Via Crystallization and Other Methods

A preferred method of separation employs selective crystallization of the distillate feed, preferably from solution. This process comprises the separation by crystallization of a petroleum distillate fraction, containing major amounts of 1-n-olefins and n-paraffins with at least two preferably at least three different carbon numbers per molecule, to obtain crystals mostly consisting of 1-n-olefins and n-paraffins.

Prior to separation by crystallization the feed is preferably diluted with a volatile solvent. Preferred solvents are selected from the group of hydrocarbons, oxygenated solvents and $CO_2$. Exemplary solvents are propylene and methyl ethyl ketone. Crystallization is effected by cooling the feed. The crystals formed are separated, for example by filtration using techniques developed for lube oil dewaxing and p-xylene separation.

To enhance filtration, crystals containing n-paraffins and 1-n-olefins are preferably modified by additives. Additives developed for wax crystal modifications are effective. For example, a copolymer of ethylene and vinyl acetate, Paranox 25, and the like can be used. Such additives control crystal growth. Thus more readily filterable and washable crystals with less occluded impurities are produced. For the production of crystals of high purity, the washcrystal method is particularly suited. Using this method the paraffin-olefin crystals are washed with the melt of the same to remove impurities.

Another preferred method of separation in the present process employs liquid-liquid extraction. This process comprises the separation by extraction with a polar solvent of a petroleum distillate fraction derived via the high temperature thermal cracking of petroleum residua, i.e. a feed containing major amounts of 1-n-olefins, n-paraffins and greater than 0.1% sulfur to provide an extract enriched in aromatic hydrocarbon and sulfur components. The polar solvents are preferably selected from the group consisting of organic nitrogen, oxygen, sulfur and phosphorus compounds.

Exemplary organic nitrogen compounds are amines, amides and nitriles such as triethanolamine, N-methylpyrrolidone, dimethylformamide, acetonitrile, $\beta$, $\beta$-oxydipropionitrile, 1,2,3- tris(2-cyanoethoxy) propane. Examples of organic oxygen, sulfur and phosphorus compounds are ethylene carbonate, diethylene glycol, tetraethylene glycol, butyrolactone, methanol, sulfolane, diethyl sulfone, trimethylphosphate. The selectivity of most of these polar organic compounds can be enhanced by the addition of appropriately minor amounts of water.

The suitability of a solvent is mainly determined by its group selectivity. This is directly related to the polarity of the solvent. The groups of interest are aromatic compounds including sulfur containing aromatics on one side, olefins and paraffins on the other. Group selectivity changes with increasing boiling ranges of the feed since the character of the aromatic components changes from mononuclear to dinuclear compounds, etc. With an increasing number of fused aromatic rings, the polarity of the present feed components increases. Thus the selectivity is also increased.

Another important factor is solvent power which determines the amount of solute contained in the solvent phase. As such, it affects the economy of a given solvent. The third basic factor is solvent selectivity for low versus high boiling components, e.g. light-heavy selectivity. This selectivity factor should be usually at a minimum. However, since the feed of the present invention is preferably a narrow distillate cut, the value of this factor has often no effect on the separation.

The solvent is usually higher boiling than the coker distillate feed. Thus, the extracted distillate components can be recovered by fractional distillation and the solvent recycled. Alternatively, especially in case of high boiling coker gas oil fractions, the solvent can be much lower boiling. In such a case the solvent is recovered as a distillate and the extract remains as a residual product. The solvent can be also recovered from the extract by membrane separation. For example, acetonitrile is a highly suitable solvent for recovery by the membrane technique.

Another preferred method of separation employs a solid adsorbent such as clay, alumina, alumino-silicates, fullers earth, silica gel. These adsorbents when contacted with the present distillate feeds of high temperature thermal cracking generally effect separation into a fraction enriched in aliphatic compounds and a fraction in aromatic hydrocarbon and sulfur components.

One group of adsorbents consists of highly polar materials. They are highly polar solids such as silica gel or solids covered by a highly polar stationary phase such as polyethylene glycol on a solid carrier. Such solids effect chromatographic separation. When in contact with the present feed they retain the components of the present feed in proportion to their polarity. Using a narrow distillate fraction as a feed, the paraffin components are eluted at first followed by the olefins and then by the mononuclear and binuclear aromatics, etc.

Combined Separation Processes

The separation process steps of the present invention can be advantageously combined with each other or with selective chemical conversion processes to provide single types of chemicals based on Flexicoker distillates. In the following these combinations will be discussed in some detail.

The separation by crystallization of 1-n-olefin n-paraffin mixtures can be combined with their further separation using molecular sieves to provide 1-n-olefins containing both even and uneven numbers of carbons per molecule. Alternatively, the mixtures can be first distilled to obtain single carbon fractions. The n-paraffins can then be selectively crystallized and separated from the n-olefin rich liquid phase.

Instead of further separation, the 1-n-olefin components of these mixtures of 1-n-olefins and n-paraffins are preferably reacted selectively leaving unconverted n-paraffins behind. For example, the 1-n-olefins can be hydroformylated, i.e. reacted with CO nd $H_2$, to provide aldehydes and/or alcohols of high linearity. They can be reacted with aromatics such as phenol to produce via alkylation the corresponding linear alkylaromatic compounds, i.e. alkylphenols. The 1-n-olefins can be also oligomerized, preferably by acid catalysts, to provide low molecular weight polyolefins.

The aliphatic raffinate can also be reacted selectively to convert to olefinic components and leave a mixture of paraffins unconverted. Selective reactions for olefin conversion are the same as discussed above.

The aromatic extract can be further separated for example by crystallization. E.g. p-xylene, durene and naphthalene can thus be separated. Alternatively, the aromatic extract can be selectively hydrogenated to remove the sulfur compounds present. The aromatic compounds in the presence and in the absence of thiophenic sulfur compounds can be alkylated with olefins to provide alkylaromatic products with or without sulfur. The alkylation of dinuclear aromatics with higher olefins, preferably in the $C_{15}$–$C_{30}$ range, is preferred to provide nonvolatile solvents.

Conversions

The olefin components of n-olefin plus n-paraffin mixtures obtained in the present separation process are advantageously converted to higher boiling derivatives and then separated from the unreacted n-paraffins. These conversions generally comprise known chemical reactions and processes. The preferred conversions are oligomerization, alkylation of aromatic compounds and carbonylation of olefins. A preferred aspect of the present invention is a unique combination of separation via urea adduction or crystallization and selective conversion of n-olefin plus n-paraffin mixtures followed by the separation of the n-paraffin.

The preferred mixtures of n-olefins and n-paraffins of the present invention contain 1-n-olefins as the main olefinic components. These 1-n-olefins are the preferred reactants in numerous types of conversions which are more specifically polymerization, particularly oligomerization, alkylation, carbonylation and various other olefin conversions. In the following, mainly the conversion of 1-n-olefins to oligomers will be discussed. Internal n-olefins generally undergo similar conversions at a lower rate.

The acid catalyzed and free radical oligomerization of 1-n-olefins is widely known. In the present process acid catalysed oligomerization in the liquid phase is preferred. The catalysts are generally strong acids such as phosphoric acid, sulfonic acid, aluminum chloride, alkylaluminum dichloride and boron trifluoride complexes. Boron trifluoride complexes are preferably those of protic compounds such as water, alcohols, and protic acids. Using $BF_3$ complexes, cracking side reactions are avoided.

The oligomerizations are generally carried out in the −100 to −100° C. temperature range at atmospheric pressure. Superatmospheric pressure may be used to assure a liquid phase operation. The number of monomer units in the oligomer products is 2 to 30, preferably 2 to 6.

The most preferred oligomerizations produce polyolefin intermediates for synthetic lubricants. The preparation of synthetic lubricants via the polymerization of even numbered, pure 1-n-olefins was reviewed by J. A. Brennan in the journal, Ind. Eng. Chem. Prod. Res. Dev., Vol., 19, pages 2–6 in 1980 and the references of this article. These articles are incorporated by reference. Brennan concluded that isoparaffins, derived from 1-n-decene via trimerization catalyzed by boron trifluoride followed by hydrogenation, possess superior lubricant properties. Due to the position and length of their n-alkyl chains these trimers also exhibit superior stability. Their viscosity is relatively insensitive to temperature changes. Based on these and similar studies $C_8$, $C_{10}$ and $C_{12}$ α-olefin based lubricants, having about 30 to 40 carbon atoms per isoparaffin molecule, were developed.

More recently synthetic lubricants were also developed on an internal olefin basis. U.S. Pat. Nos. 4,300,006 by Nelson and 4,319,064 by Heckelsberg et al. discuss the synthesis of such lubricants via the $BF_3$ catalysed dimerization of linear internal olefins derived via α-olefin metathesis of lubricants via the codimerization of linear internal and terminal, i.e. α-olefins. These patents are also incorporated by reference.

According to the present invention, the n-olefin components of a mixture of n-olefins and n-paraffins are converted into oligomers by reacting them in the presence of an acid or a free radical catalyst preferably and acid catalyst. In a preferred conversion step. oligomers containing an average of 3 to 4 monomer units, i.e. trimers and tetramers, are produced by reacting a mixture rich in $C_9$ to $C_{13}$ 1-n-olefins and n-paraffins, in the presence of a boron trifluoride complex. In an alternative step, the 1-n-olefin and internal normal olefin components of a $C_{13}$ to $C_{17}$ mixture of n-olefins and n-paraffins are cooligomerized to produce oligomers containing an average of 2 to 3 monomer units.

Another preferred acid catalysed oligomerization of n-olefins, produces polyolefins in the $C_{16}$ to $C_{50}$ carbon range. These are subsequently used to alkylate benzene to produce $C_{16}$ to $C_{30}$ alkylbenzene intermediates for the synthesis of oil soluble Ca and Mg alkylbenzene sulfonate detergents. The preferred alkylating agents are dimers.

The unconverted paraffin components of the n-olefin oligomer product mixture are removed preferably by distillation. The distillation is performed either right after the oligomerization or subsequent to the next conversion step comprising either hydrogenation to isoparaffins or benzene alkylation by the oligomers to alkylbenzenes.

Phenol alkylation by n-olefins leads to linear alkylphenol intermediates of ethoxylated surfactants. Phenol is highly reactive and can be readily alkylated in the presence of a crosslinked sulfonated styrene-divinyl benzene resin, Amberlyst 15, at 80 to 150° C. Methods of phenol alkylation are discussed in U.S. Patent application Ser. No. 113,619 by Oswald et al., filed on Oct. 26, 1987 which is incorporated by reference. Other conversions are described in copending U.S. Patent application Case No. 2291 by Oswald et al. filed on Dec. 7, 1988 which is incorporated by reference.

Example 1

Separation of the α-Olefin Plus n-Paraffin Components of Light Flexicoker Gas Oil (LKGO) by Adding the Oil to a Methanolic Urea Solution To a solution of 510 g urea in 3 L methanol 900 mL (789.6 g) of stirred light Flexicoker gas oil was added. Precipitation of yellowish urea adducts occurred immediately. After 45 minutes of stirring, the mixture was filtered with suction and washed three times each with 300 ml isooctane to obtain 368g white crystalline adduct.

The filtrate of the reaction mixture separated into a lower oily phase (about 10%) and an upper methanolic phase (about 90%). GC analysis indicated that the methanol dissolved some of the lower molecular weight components of the gas oil. Washing with i-octane removed methanol (about 80%) and additional amounts of the oil (about 20%) from the adduct.

The adduct was dried in vacuo overnight to remove the residual i-octane (about 65%) and methanol (about 35%). The remaining dry adduct, 213g. was added to 1800 ml of water and stirring. The stirred mixture was heated to 70° C. to complete the decomposition of the adduct and then allowed to cool to room temperature. This resulted in the separation of 44g of an upper hydrocarbon phase. The lower, hazy water phase yielded an additional 1.8g of hydrocarbons on extraction with 600 ml of hexane. Thus the total yield was 9 wt/wt% based on the feed.

A comparative analysis of the hydrocarbons recovered via urea adduction and of the light Flexicoker gas oil feed by capillary gas chromatography indicated a great enrichment of the recovered hydrocarbons in the 1-n-olefin and n-paraffin components. This is illustrated by the gas chromatograms in FIGS. 1 and 2.

Figure 1A:
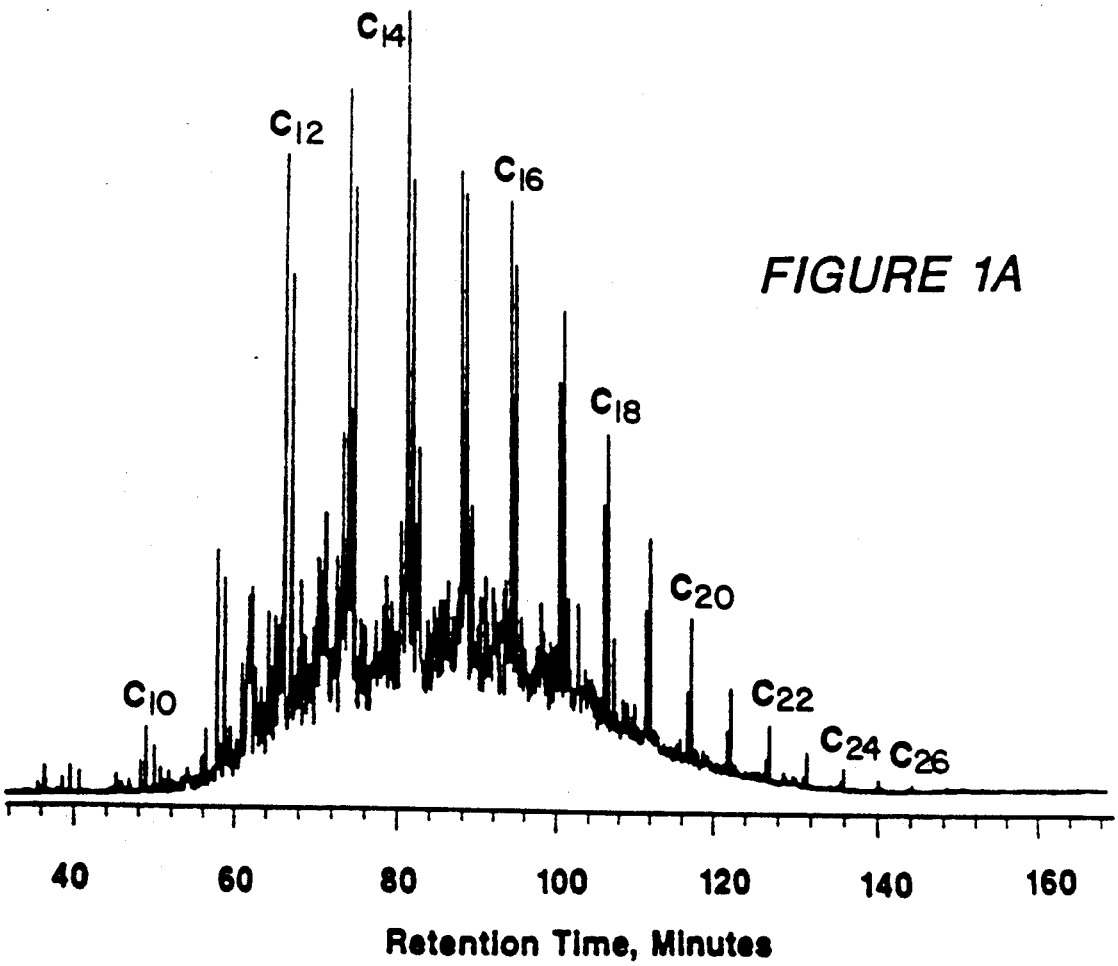

The upper part of FIG. 1 shows the gas chromatogram recorded by a Flame Ionization Detector of the organic compounds in general. The tall doublet peaks indicate the presence of 1-n-olefin - n-paraffin pairs of the same carbon number in the $C_{10}$ to $C_{26}$ range. These are the largest single compound components of the mixture. The 1-n-olefin component is always of a shorter retention time than the corresponding paraffin. In the C10 to C16 range, the 1-n-olefin components are present in a larger concentration than the n-paraffins. The unresolved hump of the figure indicates the presence of an extremely high number of individual components present.

The lower part of FIG. 1 shows the corresponding chromatogram for sulfur compounds. It is noted that the sulfur detector had a near to square response to sulfur concentration. A comparison of the peak heights of the sulfur compound components with that of a standard sulfur compound containing 100 ppm sulfur indicates the presence of numerous sulfur compounds at greater than 100 ppm sulfur concentration.

Figure 2A:
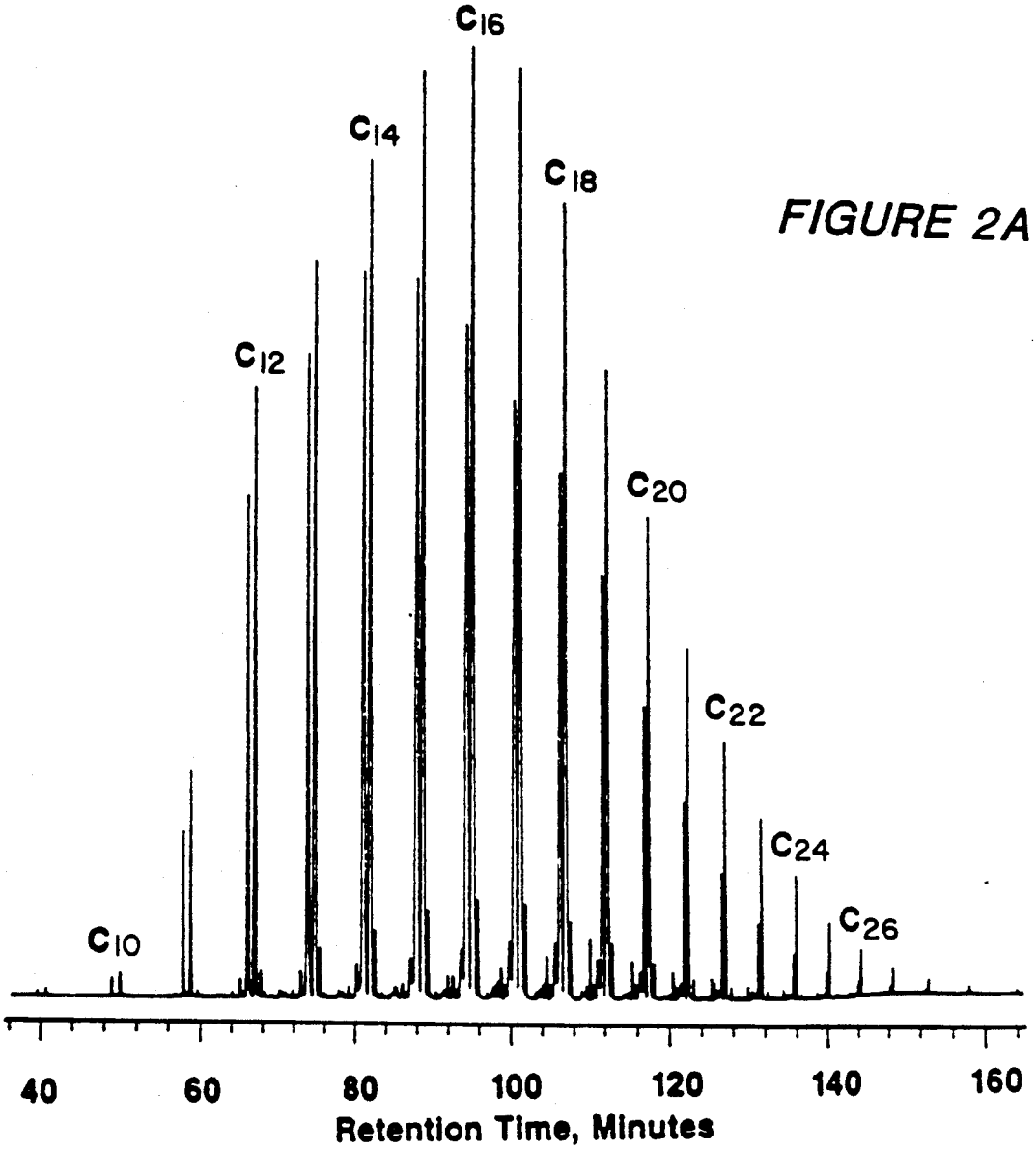
FIG. 2A and 2B for flame detector and sulfur detector, respectively illustrates by capillary gas chromatograms the composition of mixtures of 1-n-olefins and paraffins separated from light Fluid-coker gas oils.
Figure 2B:
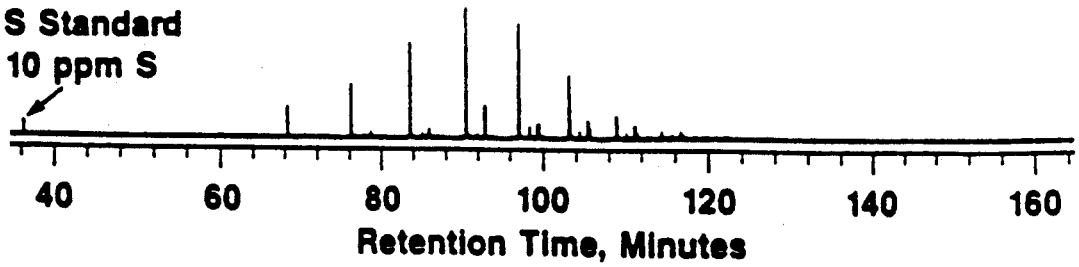

The upper part of FIG. 2 shows the FID chromatogram of the 1-n-olefin - n-paraffin mixture separated from the light Flexicoker gas oil feed of Figure. The tall 1-n-olefin -n-paraffin doublet peaks of this figure represent more than 90% of this mixture. Combined gas chromatography mass spectrometry showed that minor distinguishable components of the mixture are 2- and 3-olefins, 2-methyl substituted 1-olefins and 2- plus 3-methyl substituted n-alkenes.

A comparison of the relative GC FID peak intensities of FIG. 1 and FIG. 2 shows that the 1-n-olefin to n-paraffin ratio of the separated product is decreased. The olefin separation was less efficient than n-paraffin separation. n-Paraffin recovery was particularly efficient in the higher $C_{20}$ to $C_{26}$ region.

The lower part of FIG. 2 similarly shows the S specific gas chromatogram of the hydrocarbons separated via urea adduction. A comparison with the S specific GC of the feed in FIG. 1 shows a tremendous reduction of sulfur content. All the remaining sulfur compounds of FIG. 2 are present in concentrations equivalent to or less than 100 ppm sulfur. It is also apparent that the remaining sulfur compounds are not the main sulfur compounds of the feed. The main sulfur compounds of the feed are aromatics such as benzothiophenes and dibenzothiophenes. The main sulfur compounds remaining in the product appear to be homologous n-alkyl mercaptans.

Figure 3:
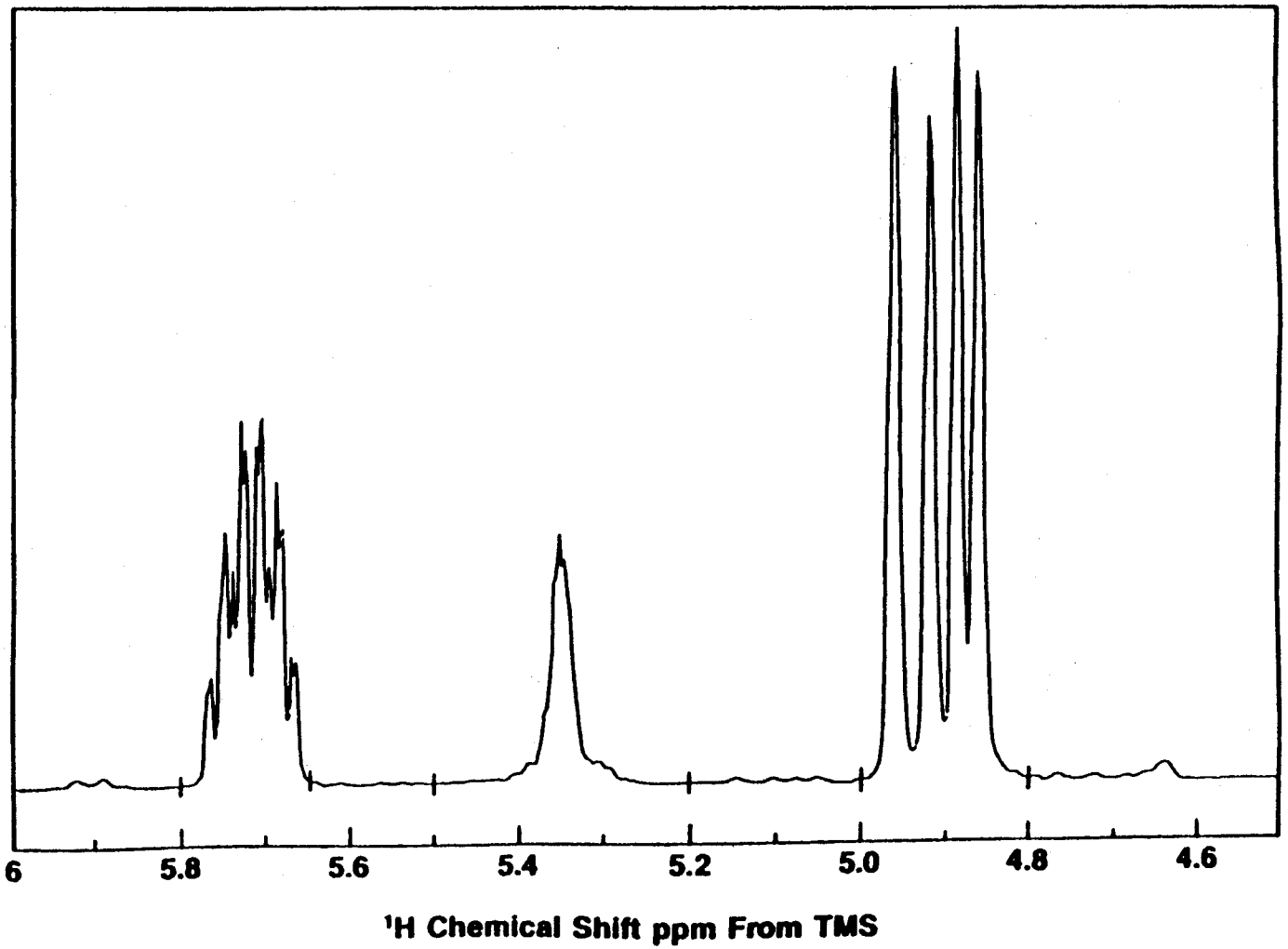
FIG. 3 illustrates by $^{1}H$ nuclear magnetic resonance spectrum of the vinylic region the amounts of various types of olefins separated from light Fluid-coker gas oils.
Figure 4:
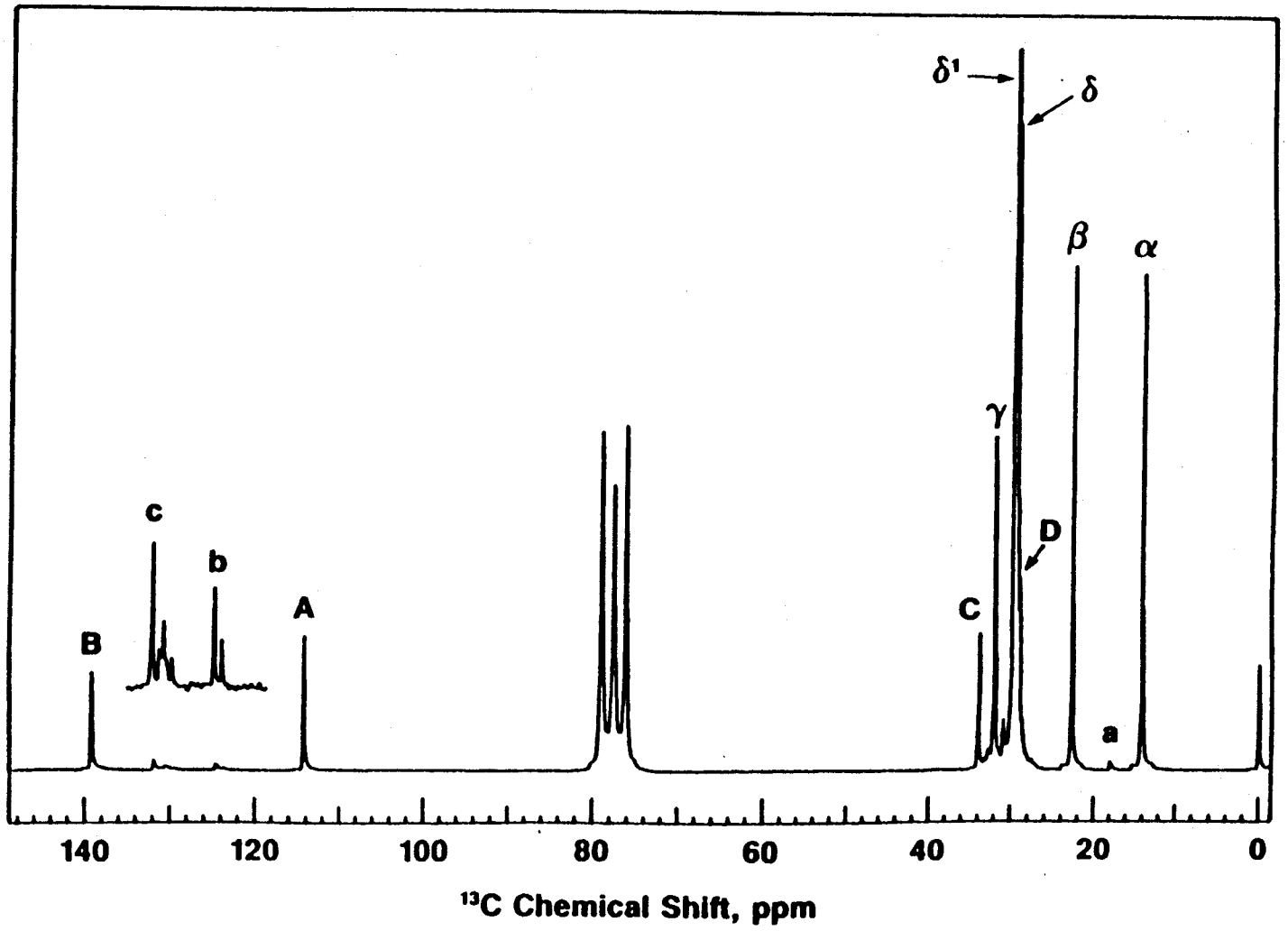
FIG. 4 illustrates by $^{13}C$ nuclear magnetic resonance spectrum the chemical structure of the main 1-n-olefin and n-paraffin components of the product separated from light Fluid-coker gas oils.

To obtain further information on the minor hydrocarbon components of the product, high resolution nuclear magnetic resonance (NMR) spectometric analyses were also performed. The $^1H$ and $^{13}C$ NMR spectra are shown by FIGS. 3 and 4, respectively.

The $^1H$ NMR spectrum showed the presence of methylene, methine and methyl protons plus the vinylic protons of the olefinic groups. Aromatic protons were essentially absent. The .relative amounts of the various types of olefins were indicated by the relative intensities of the various vinylic hydrogens between 6.5 and 4.5 ppm as shown by FIG. 3. The intense peaks between 4.8 and 5.0 and 5.64 and 5.8 ppm showed that the Type I monoolefins having monosubstituted vinyl groups, $R—CH{=}CH_2$ are the most common type. Type I olefins, of course, include 1-n-olefins, one of the most common type of compounds of the present mixture according to GC. The other significant peak found at 5.75 ppm in the 5.15 to 4.95 ppm refion is due to the symmetrically disubstituted vinyl groups, —CH=CH—, of type II olefins. The linear internal olefins belong to this group.

In addition, there were very small peaks in the 4.5 to 4.8 ppm region commonly assigned to the hydrogens of the unsymmetrically disubstituted vinyl groups, $R_2C{=}CH_2$. of Type III olefins. The 2-methyl substituted terminal olefin components of this type had a chemical shift value of about 4.65 ppm. There were also some peaks in the 5.0 to 5.2 chemical shift region which is normally for the vinylic hydrogen of the trisubstituted olefins, $R—CH{=}CR_2$, of Type IV. These peaks were presumably due to monobranched olefins having $—CH{=}C(CH_3)_2$ groups. There was also an indication of the presence of linear conjugated diolefins, presumably having structural units of the formula —CH=CH—CH=CH—.

The $^{13}C$ NMR spectrum, confirmed the structure of the components indicated by GC/MS and $^1H$ NMR. As indicated by the figure, characteristics $^{13}C$ peaks were found for the inner methylene groups and the terminal methyl group and the adjacent methylenes. Additionally, in the olefinic carbon regions, the intense peaks of the $—CH{=}CH_2$ carbons of the 1-n-olefins and the various less intense carbon peaks of the Type II and Type III olefins were observed. The spectrum showed no indication of other than methyl carbon branching.

Example 2

Separation of the α-Olefin Plus n-Paraffin Components of LKGO by the Addition of a Methanolic Urea Solution to the Oil A solution of 1020 g urea in 6 L methanol was slowly added to 1800 ml (1592 g) of well stirred light Flexicoker gas oil. By the time 500 ml urea was added a yellow precipitate started to form. After all the urea was added, stirring of the resulting suspension was continued for an hour.

The final reaction mixture was worked up in a manner described in Example 1. The amount of dry urea adduct obtained was 506 g. On treating the adduct with hot water, 106 g of α-olefin -n-paraffin mixture separated as a top phase. Hexane extraction of the aqueous phase and subsequent removal of the hexane by film evaporation resulted in the recovery of another 4.5 g product. Thus the total yield of the product was 110.5 g (6.9%).

The oil plus methanol filtrate was cooled in a −20° C. freezer for 4 hours, then filtered to obtain additional urea adducts which were washed with isooctane and dried in vacuo as usual. In this manner an additional 300 g of adduct was obtained which on treatment with hot water provided 61.5 g (3.9%) α-olefin - n-paraffin product mixture as an upper phase. A subsequent extraction of the lower water phase provided an additional 2 g (0.1%) product. Thus altogether 174 g (10.9%) product was obtained.

A comparison of capillary GC's of the product fractions showed that the second batch of oil product (61.5 g) derived from the urea adduct crystallized from the cold reaction mixture contained less n-paraffin than 1-n-olefin in contrast to the first batch and the products of the first example. In the second batch, the percentage of the internal olefins and monomethyl branched paraffins also increased. Cooling of the reaction mixture apparently increases the yield of the total olefins but results in a decrease of the ratio of 1-n-olefins to the total olefins. Sulfur specific GC's also indicated that the number and concentrations of sulfur compounds were much higher in the second batch of product.

Example 3

Separation of the α-Olefin Plus n-Paraffin Components of LKGO by the Addition of a Methanolic Urea Solution to the Oil and Subsequent Cooling of the Mixture A methanolic solution of 1020 g urea was reacted with 1800 ml (1578 g) Flexicoker gas oil in a manner described in the previous example. The stirred reaction mixture was then cooled with ice to 7° C. Thereafter, the crystalline urea adduct was filtered, washed, dried and reacted with hot water as before. This resulted in the separation of 94 g product. A subsequent extraction of the water phase with 500 ml and then 200 ml hexane, provided another 65 g product. Thus the total yield was 159.1g (10.1%).

GC analyses showed that the composition of the two product fractions was virtually the same. Both fractions contained a slightly higher concentration of α-olefins than the product of the first example.

Example 4

Separation of the α-Olefin Plus n-Paraffin Components of LKGO by the Addition to the Oil of an Increased Excess of Urea in Methanol A warm (50° C.) solution of 2000 g urea in 8 L methanol was added to 1800 mL (1578.4 g) light Flexicoker gas oil with stirring. The resulting reaction mixture was stirred for 90 minutes and then cooled by an ice water bath to 10° C. with continued stirring. Thereafter, the mixture was worked up and the adduct reacted with hot water as in the previous example to provide 173.2g (11%) of oil as the main product. A subsequent extraction of the water phase with hexane (2×500 ml) and ether (2×500 ml) resulted in 15.5 g and 7.6 g additional products of the same composition, respectively. Thus the total yield of the combined product was 12.4%.

The composition of the product was determined by capillary GC and is shown by Table I.

TABLE I

α-Olefin and n-Paraffin Content of Linear Hydrocarbon Mixture Derived from Light Flexicoker Gas Oil Via Urea Adduction

| | 1-n Olefin, C=, % | n-Paraffin, C.°, % | Ratio, C=/C.° |
|---|---|---|---|
| $C_{10}$ | 0.08 | 0.13 | 0.66 |
| $C_{11}$ | 0.88 | 1.88 | 0.75 |
| $C_{12}$ | 4.03 | 5.21 | 0.77 |
| $C_{13}$ | 6.36 | 6.98 | 0.91 |
| $C_{14}$ | 7.87 | 7.48 | 1.05 |
| $C_{15}$ | 7.70 | 7.41 | 1.04 |
| $C_{16}$ | 6.23 | 6.34 | 0.98 |
| $C_{17}$ | 4.18 | 3.62 | 1.15 |
| $C_{19}$ | 1.25 | 1.98 | 0.63 |
| $C_{20}$ | 0.64 | 1.20 | 0.56 |
| $C_{21}$ | 0.33 | 0.70 | 0.46 |
| $C_{22}$ | 0.18 | 0.43 | 0.41 |
| $C_{23}$ | 0.12 | 0.24 | 0.47 |
| $C_{10}$–$C_{23}$ | 43.0 | 45.3 | 0.95 |

Table I shows the percentages of the 1-n-olefin and n-paraffin components of different carbon numbers. The total percentage of the α-olefins is 43%. Most of these olefins (36.4%) are in the $C_{13}$ to $C_{17}$ range. The overall ratio of α-olefins to n-olefins is close to one (0.95).

It was noted that the dry weight of the urea adduct in this example was 6.4 times greater than that of the final product. In the previous examples the adduct to produce weight ratio was ranging from 4.7 to 5.4. This indicates that the excess urea reactant may crystallize from the reactant solution without adversely affecting the separation process.

Example 5

Separation of the α-Olefin Plus n-Paraffin Components of LKGO by the Addition to the Oil of Urea in 2 to 1 Ethanol/Methanol Mixture A 2 to 1 ethanol/methanol mixture was used as a solvent for the urea reactant because it contains sufficient amounts of ethanol for miscibility with the light Flexicoker gas oil. A nearly saturated solution of 25.5 g urea in 100 ml of this solvent mixture was added to 45 ml (35.9 g) of LKGO with stirring. Stirring of the reaction mixture was continued for 30 minutes. The urea adduct was then separated by filtration, washed three times with 15 ml isooctane and dried. The dry adduct was then reacted with hot water. This resulted in the separation of 4.6 g (11.6%) of oil product having a composition similar to that of the previous example.

Example 6

Distillation of the α-Olefin Plus n-Paraffin Mixture Separated From LKGO Via Urea Adduction The α-olefin and n-paraffin rich products obtained via urea adduction in the previous examples were combined and fractionally distilled at about 16 mm using an Oldershaw column having 20 theoretical plates. The boiling ranges, amounts and the main components of the fractions obtained are shown in Table II.

TABLE II

α-Olefin ($C_n$=) and n-Paraffin (Cn°) Components of Fractions From the Distillation at 16 mm of the Linear Hydrocarbons Separated Via Urea Adduction

| | Initial Bp., °C. | Amount | | Components Determined by Capillary Gas Chromatography, % | | | | | | | | | | | | | |
|---|---|---|---|---|---|---|---|---|---|---|---|---|---|---|---|---|---|
| | | | | Undecenes | | Dodecenes | | Tridecenes | | Tetradecenes | | Pentadecenes | | Hexadecenes | | Heptadecenes | |
| No. | 16 mm | g | % | $C_{11}$= | $C_{11}$° | $C_{12}$= | $C_{12}$° | $C_{13}$= | $C_{13}$° | $C_{14}$= | $C_{14}$° | $C_{15}$= | $C_{15}$° | $C_{16}$= | $C_{16}$° | $C_{17}$= | $C_{17}$° |
| I | Feed | 605.0 | 100 | | | | | | | | | | | | | | |
| III[a] | 82 | 52.5 | 8.7 | 4.62 | 8.78 | 42.82 | 35.28 | | | | | | | | | | |
| IV | 96 | 17.5 | 2.9 | | | 26.54 | 49.28 | 9.56 | 5.93 | | | | | | | | |
| V | | 17.6 | 2.9 | | | 7.30 | 23.92 | 37.86 | 13.26 | | | | | | | | |
| VI | 110 | 79.7 | 13.2 | | | | | 31.98 | 36.00 | 14.83 | 9.14 | | | | | | |
| VII | 118 | 97.1 | 16.1 | | | | | 2.97 | 5.45 | 20.96 | 30.29 | 14.57 | 9.45 | | | | |
| VIII | 134 | 58.8 | 9.7 | | | | | | | 1.12 | 2.32 | 37.88 | 43.05 | 4.13 | 1.79 | | |
| IX | 144 | 56.5 | 9.3 | | | | | | | | | 2.87 | 5.74 | 44.81 | 35.96 | | |
| X | | 24.7 | 4.1 | | | | | | | | | | | 15.08 | 43.49 | 14.85 | 13.21 |
| XI[b] | 160 | 59.3 | 9.8 | | | | | | | | | | | 0.50 | 3.83 | 31.76 | 41.41 |

[a]The distillate forerun (12 g) contained 6.11% $C_{10}$=; 6.98% $C_{10}$°; 40.41% $C_{11}$=; 32.74% $C_{11}$°
[b]The last distillate fraction (59.8 g) was obtained while the pressure was reduced to 0.1 mm.
[c]The distillation residue was 49.3 g It is indicated by the data of Table II that fractions rich in single carbon α-olefin components could be obtained. At the end of the distillation, the pressure was reduced to 0.1 mm to obtain an additional fraction (59.8 g) of the following percentages of main components: 18.97 $C_{18}$=; 30.00 $C_{18}$°; 9.71 $C_{19}$=; 15.41 $C_{19}$°; 2.38 $C_{20}$=; 4.28 $C_{20}$°. An analysis by packed column GC gave the following carbon number distribution for this fraction 57.3 $C_{18}$; 30.5 $C_{19}$; 8.0.

Example 7

Separation of n-Decenes Plus n-Decane from a $C_{10}$ Flexicoker Distillate Fraction by the Addition of a Methanolic Urea Solution To 500 ml (401 g) of an aqueous caustic treated $C_{10}$ Flexicoker naphtha fraction (bp. 166 to 171° C.) of 17% n-1-decene and 11.3% n-decane content, a solution of 500 g urea in 2 L of methanol was added, with stirring. The stirred mixture was cooled to 0° C. using an ice-salt mixture and then filtered by suction through a Buchner funnel. The urea adduct crystals were washed three times with 300 mL each of i-octane and dried in vacuo to provide 399 g of dry intermediate.

The adduct was added to 3600 mL of hot (70° C.) stirred water to liberate the n-decenes-n-decane mixture which was successively extracted from the water by 500 ml n-hexane and 500 mL ether. (The hydrocarbon extract was a stable emulsion). The combined extracts were washed with 200 mL water and the solvent stripped off to provide 73 g of the residual product. Cooling the filtrate of the reaction mixture to −20° C. resulted mostly in urea crystallization.

The composition of the product is illustrated by the capillary gas chromatogram of FIG. 3. The quantitative GC data show the presence of 44.8% 1-n-decene and 36.8% n-decane in the product. Based on these data 48% of the starting 1-n-decene was recovered from the starting Flexicoker distillate. The remaining minor components of the separated product mixture are mainly linear internal decenes: cis-and trans-2-decene 3-, 4- amd 5-decenes. 2-Methyl-1-nonene and 2-methylnonane were also present in small quantities as indicated by the Figure. The small amounts of 1-n-nonene and n-nonane present in the feed were also isolated with the main n-$C_{10}$ aliphatic hydrocarbon components.

The results indicate that the 1-n-olefin - n-paraffin mixtures isolated via urea adduction contain significant amounts of linear internal olefins of Type II and smaller amounts of monomethyl branched terminal olefins of Type III. The presence of these minor olefin components have no adverse effects on the properties of the novel lubricants derived from these mixtures. Under appropriate conditions, attractive lubricants having a unique balance of properties can be produced.

The separation of 1-n-decene n-decane mixtures via urea adduction was found to be highly dependent on the absence of oxidative aging of the $C_{10}$ Flexicoker feed fraction. When an aged sample of the same distillate was used for urea adduction, the yield of 1-n-decene n-decane mixture was reduced to about 10% of the previously obtained amount. Also, the percentage of 1-n-decene in the mixture was somewhat smaller than before: The mixture of reduced yield contained 40.4% 1-n-decene and 44.8% n-decane.

Example 8

Oligomerization by $BF_3$-$C_5H_{11}OH$ of Dodecenes Fraction Derived From Urea Adducts of Light Coker Gas Oil To 20 g of the stirred dodecenes distillate fraction of Example 6, 3.1 g (0.02 mole) of 1:1 $BF_3$ n-pentanol complex was added. The added complex formed a separate bottom phase which was well dispersed in the hydrocarbon medium by the stirring during the reaction. A slight exotherm, i.e. warming of the reaction mixture to 25° C., was observed. A GC analysis of the mixture one hour after the addition of this catalyst showed only about 4% conversion of the reactants to dimers.

To form a more effective catalyst system, BF3 gas was introduced into the reaction mixture until saturation for 10 minutes with continued stirring. This resulted in a greater exotherm, up to 40° C. In another hour, the composition of the mixture was again determined by GC. It was found that most of the olefin components were reacted to form dimers and trimers. According to packed GC the upper product phase consisted of about 44% $C_{10}$ feed, 11% of $C_{20}$ dimer and 45% $C_{30}$ trimer. Capillary GC showed that 95% of the unconverted $C_{10}$ feed was paraffinic. The percentages of n-undecane and n-dodecane were 18.6% and 69.I%, respectively. After stirring the reaction mixture over the week-end, all the olefins were reacted.

After the completion of the reaction, the lower catalyst phase of the reaction mixture was separated. It was 4 g, double the amount of the initially added catalyst.

Example 9

Oligomerization of Dodecenes from Urea Adducts of LKGO by $BF_3$-$(CH_3)_3C$-$CO_2H$ To 20 g of the stirred ice-water cooled dodecenes distillate fraction of Example 6, 3.4 g (0.02 mole) of a 1:1 $BF_3$ neopentanoic acid was added. A slight exotherm was observed. After hour, packed column GC analysis indicated the presence of about 7% dimers and 3% trimers, plus 5.5% isomeric undecyl neopentanoate esters. After overnight stirring, selective dimerization was almost complete. About 35% dimers, 5% trimers and 4% esters were present. The remaining 56% $C_{10}$ hydrocarbons contained 92% paraffins and only 8% olefins according to capillary GC.

Sulfur specific capillary GC showed that most of the sulfur compounds of the $C_{12}$ feed were converted to higher molecular weight species: The presence of a thiolester among the neopentanoates and several sulfur compounds presumably thiethers in The dimer range were indicated.

Example 10

Oligomerization of $C_{10}$ to $C_{18}$ n-Olefins Derived from Urea Adducts by $C_2H_5AlCl_2$ The distillate fractions of Example 6 —which were obtained by the fractional distillation of the n-olefin - n-paraffin mixtures separated via urea adduction from light Flexicoker gas oil in Example to 6 —were used as feeds for oligomerization in the present example. The composition of these feeds is listed Table II of Example 6. The $C_{13}$-$C_{15}$ reactant fraction consisted of the combination of fractions VI and VII. It contained 15% $C_{13}$=, 21% $C_{14}$= and 21% $C_{15}$= n-olefins. The $C_{15}$ reactant was fraction VIII. The $C_{16}$ reactant was fraction IX. As the $C_{17}$ reactant fraction XI was employed. Additionally, a mixture containing 43% n-decenes—obtained in a similar manner from a $C_{10}$ Flexicoker fraction—was used to prepare n-decene oligomers on a larger scale. Ethylaluminumdichloride was employed as a liquid Friedel-Crafts type catalyst in all the experiments of the example.

The typical experiments were carried out atmospheric pressure in a nitrogen blanketed two neck round botton flask equipped with a condenser, a magnetic stirrer, a thermometer, a dropping funnel and a heating mantle. n-Olefin—n-paraffin reactant mixtures of the composition shown in Table III were added into the reaction flask. Their quantities ranged from 19 to 84 grams. The amount of the ethylaluminum dichloride (EADC) catalyst employed was 4 mole % (4 m EADC per 100 moles olefin). The EADC was added to the stirred olefin as a 26% heptane solution at once at ambient temperature. On the addition of the catalyst solution an instantaneous exothermic reaction occurred. This usually resulted in a temperature rise of the reaction mixture to 30–40° C. Once the temperature stopped rising, heat was applied to raise the reaction temperature to 150° C. and to keep there for 1 hour. Thereafter, samples of the reaction mixtures were analyzed.

The reaction mixtures were allowed to cool and then treated with excess water to hydrolyze the catalyst. This usually resulted in the formation of an emulsion which was treated with an about 30% aqueous sodium hydroxide solution to break it. The hazy organic phase was then filtered through a Celite 512 to get clear liquid products. These products were then stripped at reduced pressure while heated to remove any volatile components, i.e. hydrocarbons having less than 20 carbon atoms per molecule.

The hydrocarbon reaction mixtures and residual oligomeric products were analyzed by gas chromatography The results are shown by Table III.

example. These properties, the magnitude and temperature dependence of viscosity and low temperature flow, are similar for the polyolefins and their hydrogenated isoparaffin derivatives. Both properties depend on the molecular weight, branchiness and n-alkyl side chain length.

The molecular weight distribution of the residual products was further studied by gel permeation chromatography i.e. GPC. (Product components having more than 60 carbons per molecule could not be determined by GC). As it is shown by the data of Table IV, the number average molecular weights of the products (Mn) decreased with the increasing carbon number of monomers, indicating a definite decrease in the degree of polymerization. The residual products of decene and heptadecene oligomerization had a relatively larger percentage of trimers, thus a higher molecular weight, apparently as a consequence of the prior removal of some of the dimers (see Table III of the previous example). The prevalence of dimers in products of higher olefins in the $C_{14}$ to $C_{17}$ range is desirable for producing isoparaffins in the $C_{30}$–$C_{40}$ range. A combination of α-olefin isomerization plus α-olefin—internal n-olefin codimerization is a preferred route to such dimers, e.g.

TABLE III

Carbon Number Distribution of Reaction Mixtures and Reaction Products of the Oligomerization n-Olefin - n-Paraffin Mixtures Derived from Flexicoker Distillates

| Carbon | Composition of Mixture, % Total | | | | Composition of Mixture, % Minus Paraffins | | | | Composition of Product % Residuum | | | | Paraffin-Flash-off |
|---|---|---|---|---|---|---|---|---|---|---|---|---|---|
| No. of Feed | Olefin Monomers & Paraffins | Di-mers | Tri-mers | Tetra-mers | Mono-mers | Di-mers | Tri-mers | Tetra-mers | Mono-mers | Di-mers | Tri-mers | Tetra-mers | Conditions °C./mm |
| 10 | 57.6 | 7.3 | 12.8 | 9.9[a] | 1.4 | 16.9 | 29.7 | 23.0[b] | 0 | 4.8 | 36.3 | 27.9[c] | 172/0.1 |
| 13–15 | 69.4 | 18.8 | 9.7 | 2.0 | 30.2 | 43.0 | 22.2 | 4.6 | 8.6 | 62.1 | 23.5 | 5.9 | 95/0.4 |
| 15 | 69.8 | 19.9 | 8.6 | 1.7 | 37.1 | 41.5 | 17.9 | 3.5 | 0 | 68.3 | 28.5 | 3.2 | 118/0.4 |
| 16 | 64.2 | 23.0 | 10.8 | 2.0 | 29.8 | 45.1 | 21.2 | 3.9 | 2.8 | 60.1 | 33.4 | 3.7 | 118/0.4 |
| 17 | 72.2 | 17.7 | 10.1 | —[d] | 23.6 | 48.6 | 27.7 | —[d] | 5.8 | 47.3 | 46.8 | —[d] | 120/0.2 |

[a]Plus 7.9% pentamers, 3.9% hexamers, 0.7% heptamers

[b]Plus 18.3% pentamers, 9.0% hexamers, 1.6% heptamers

[c]Plus 17.0% pentamers, 10.3% hexamers, 3.6% heptamers

[d]Oligomers containing more then 60 carbon atoms could not be analyzed by Gc

The data of the table show that the olefin components of all the various olefin paraffin mixtures were oligomerized but to varying degrees. The decenes of the $C_{10}$ feed were converted to oligomers of a broad molecular weight distribution, ranging from $C_{20}$ dimers to $C_{60}$ hexamers. The main products were trimers and tetramers. Only about 1.4% unconverted decenes were present in the reaction mixture. In contrast, the $C_{13}$ to $C_{17}$ olefins of the other four reaction mixtures were mainly converted to dimers and trimers. From 24 to 37% of the olefins remained unconverted. The composition of the residual products of the $C_{13}$ to $C_{17}$ olefins on the right side of the table shows that the main components were dimers.

Example 11

Properties of Polyolefin Lubricants Derived from Mixtures of n-Olefins and n-Paraffins The key properties of the polyolefin lubricants were studied using the oligomeric products of the previous

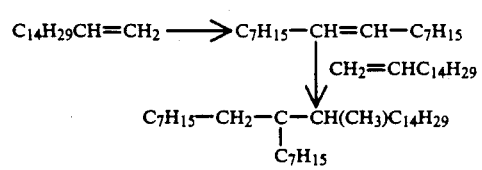

The molecular weight distribution of the residual product as defined by the ratio of number average and weight average values (Mw/Mn) is generally broad. Only the pentadecene oligomer, from which the monomer and paraffin were completely removed, has a narrow molecular weight distribution. While the pure trimer derived from 1-n-decene has ideal lubricant properties for many applications, appropriate mixtures of oligomers of broad molecular weight distribution in the dimer to hexamer range possess balanced properties, particularly suited for some applications.

TABLE IV

Physical Properties of Residual Oligomeric Products Derived from the n-Olefin Components of n-Olefin - n-Paraffin Mixtures Separated From Flexicoker Distillates

| Carbon No. of Monomer | Monomer Conversion, % | Monomer Molecular Weight | Oligomer Molecular Wt. Mn by GPC | Oligomer Molecular Wt. Distribution | Kinematic Viscosity Centistokes 40° C. | Kinematic Viscosity Centistokes 100° C. | Index V I | Pour Point °C. |
|---|---|---|---|---|---|---|---|---|
| 10 | 99 | 144 | 580 | 1.46 | 71.1 | 10.7 | 139 | −48 |
| 13-15 | 70 | | 440 | 1.39 | 20.5 | 4.8 | 165 | −27 |
| 15 | 63 | 212 | 450 | 1.14 | 32.5 | 6.6 | 164 | −15 |
| 16 | 70 | 226 | 380 | 1.29 | 38.5 | 7.4 | 160 | −9 |
| 17 | 76 | 240 | 900 | 1.51 | 115.0 | 16.6 | 156 | +3 |

As it is shown by Table IV, the residual olefin oligomers exhibit varying kinematic viscosities at 40° C. and 100° C. These viscosities increase in case of the oligomers of $C_{13}$ to $C_{16}$ olefins even though their molecular weights do not change much. More importantly, the viscosity index of these oligomers remains high indicating that their viscosity is relatively little affected by temperature changes.

Table IV also shows the pour points of the residual products according to ASTM.D97-66. This is a measure of low temperature properties; low pour point indicates good low temperature flow. The data of the table indicate that with increasing chain lengths of the olefin feeds, the oligomer products have higher pour points i.e. poorer low temperature properties. The decene oligomer has a low pour point. Both its low temperature flow properties and high temperature viscosity characteristics match those of the oligomer similarly derived from pure 1-n-decene. With increasing monomer carbon numbers, the low temperature lubricant properties decline due to the presence longer n-alkyl chains. However, at the same time the viscosity becomes less dependent on the temperature as indicated by the increased viscosity indices. The desired compromise between high pour point and high VI apparently depends on the temperature of the desired lubricant application.

Example 12

Hydrogenation of Polydecene Derived from Decenes Separated from LKGO via Urea Adduction Part of the polydecene residual product of Example 10, is hydrogenated in the presence of a sulfided cobalt-nickel catalyst under 1500 psi hydrogen pressure in the 140 to 220° C. range at a temperature sufficient not only for adding hydrogen to the olefinic unsaturation of the oligomeric feed but for the conversion to hydrogen sulfide of the sulfur compound impurities. Higher temperatures are avoided because they may result in the sulfuration of the isoparaffin product by the sulfided catalyst.

The crude isoparaffin product is purged in vacuo with heating under nitrogen to remove all the volatile by-products, mostly paraffins, having less than 25 carbon atoms per molecule.

What is claimed is:

1. A multistep process for the manufacture of polyolefin lubricants, derived mostly from $C_8$ to $C_{24}$ linear olefin components of coker distillate fractions containing more than 0.1% sulfur which are produced by the high temperature thermal cracking of petroleum residua, comprising the following three steps:

(a) enrichment of coker distillate feed in 1-n-olefin and n-paraffin components by one or more separation processes including urea adduction or crystallization, (b) oligomerization of the $C_8$ to $C_{24}$ olefin components of an enriched coker distillate fraction to produce sulfur containing $C_{30}$ to $C_{60}$ polyolefins, (c) hydrogenation of sulfur containing polyolefins to isoparaffins with the simultaneous removal of the sulfur.

2. A process according to claim 1, wherein said coker distillate feed fractions, derived from the thermal cracking of petroleum residua, contain 1-n-olefins as the main type of olefin components, the percentage of Type I olefins being more than 30% of the total olefins, and organic sulfur compounds are present in concentrations exceeding 0.5% sulfur equivalent.

3. The process according to claim 1 wherein the enrichment of the coker distillate in 1-n-olefins and n-paraffins includes their separation via urea adducts.

4. The process according to claim 1 wherein the enrichment of the coker distillate in 1-n-olefins and n-paraffins includes the crystallization of these components.

5. The process according to claim 1 wherein the oligomerization of $C_8$ to $C_{24}$ olefin components of an enriched coker distillate fraction is carried out in the presence of a cationic catalyst.

6. The process according to claim 1 wherein the hydrogenation of the sulfur containing polyolefins is carried out in the presence of transition metal sulfide catalysts.

7. A multistep process for the manufacture of polyolefin lubricants, derived mostly from $C_8$ to $C_{24}$ linear olefin components of coker distillate fractions containing more than 0.5% sulfur and 1-n-olefins as the major olefin component which are produced by the high temperature thermal cracking of petroleum residua, comprising the following three steps of:

(a) enrichment of coker distillate feed in 1-n-olefin and n-paraffin components by one or more separation processes, including urea adduction or crystallization, (b) oligomerization of the $C_8$ to $C_{24}$ olefin components of an enriched coker distillate fraction in the presence of a Friedel-Crafts catalyst to produce sulfur containing $C_{30}$ to $C_{60}$ polyolefins, (c) hydrogenation of the sulfur containing polyolefins to isoparaffin with the simultaneous removal of sulfur in the presence of transition metal sulfide catalysts.

8. The process according to claim 7, wherein the oligomerization of the $C_8$ to $C_{24}$ olefin components is carried out in the presence of a $BF_3$ complex catalyst.

* * * * *